US012404473B2

(12) United States Patent
Yuasa

(10) Patent No.: US 12,404,473 B2
(45) Date of Patent: Sep. 2, 2025

(54) LUBRICANT COMPOSITION

(71) Applicant: IDEMITSU KOSAN CO., LTD., Chiyoda-ku (JP)

(72) Inventor: Ninako Yuasa, Chiyoda-ku (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/551,425

(22) PCT Filed: Mar. 29, 2022

(86) PCT No.: PCT/JP2022/015456
§ 371 (c)(1),
(2) Date: Sep. 20, 2023

(87) PCT Pub. No.: WO2022/210709
PCT Pub. Date: Oct. 6, 2022

(65) Prior Publication Data

US 2024/0182806 A1 Jun. 6, 2024

(30) Foreign Application Priority Data

Mar. 29, 2021 (JP) ..... 2021-055697

(51) Int. Cl.

| | |
|---|---|
| ***C10M 101/02*** | (2006.01) |
| ***C10M 169/04*** | (2006.01) |
| ***C10M 171/02*** | (2006.01) |
| *C10N 20/00* | (2006.01) |
| *C10N 20/02* | (2006.01) |
| *C10N 20/04* | (2006.01) |
| *C10N 30/02* | (2006.01) |

(52) U.S. Cl.
CPC ..... *C10M 101/02* (2013.01); *C10M 169/041* (2013.01); *C10M 171/02* (2013.01); *C10M 2203/1045* (2013.01); *C10M 2290/02* (2013.01); *C10N 2020/02* (2013.01); *C10N 2020/04* (2013.01); *C10N 2020/065* (2020.05); *C10N 2030/02* (2013.01)

(58) Field of Classification Search
CPC ..... C10M 101/02; C10M 169/041; C10M 171/02; C10M 2203/1045; C10M 2290/02; C10M 2203/1006; C10M 2203/1025; C10M 2209/084; C10N 2020/02; C10N 2020/04; C10N 2020/065; C10N 2030/02; C10N 2040/04; C10N 2040/25
See application file for complete search history.

(56) References Cited

U.S. PATENT DOCUMENTS

| | | | | |
|---|---|---|---|---|
| 4,146,492 | A * | 3/1979 | Cusano | C08F 220/1818 508/473 |
| 5,565,130 | A | 10/1996 | Omeis et al. | |
| 2004/0077505 | A1 | 4/2004 | Daniel et al. | |
| 2004/0079675 | A1* | 4/2004 | Germaine | C10M 107/02 208/19 |
| 2010/0004148 | A1 | 1/2010 | Colbourne et al. | |
| 2010/0190671 | A1 | 7/2010 | Stoehr et al. | |
| 2016/0108337 | A1 | 4/2016 | Abraham et al. | |
| 2018/0163153 | A1 | 6/2018 | Cain et al. | |
| 2019/0270943 | A1 | 9/2019 | Kasai et al. | |
| 2020/0010775 | A1 | 1/2020 | Ikari | |

FOREIGN PATENT DOCUMENTS

| | | | |
|---|---|---|---|
| JP | 6-306130 | A | 11/1994 |
| JP | 2004-521977 | A | 7/2004 |
| JP | 2010-509422 | A | 3/2010 |
| JP | 2010-532805 | A | 10/2010 |
| JP | 2016-522285 | A | 7/2016 |
| JP | 2018-100329 | A | 6/2018 |
| JP | 2019-156953 | A | 9/2019 |
| JP | 2020-513309 | A | 5/2020 |
| JP | 2020-84066 | A | 6/2020 |
| JP | 2021-24978 | A | 2/2021 |
| JP | 2021-25025 | A | 2/2021 |
| WO | WO 2018/168992 | A1 | 9/2018 |

OTHER PUBLICATIONS

International Search Report issued on Jun. 7, 2022 in PCT/JP2022/015456 (with English translation), 7 pages.
Written Opinion issued on Jun. 7, 2022 in PCT/JP2022/015456 (with English translation), 8 pages.
Official communication issued in EP application 22780920.9 on Mar. 3, 2025.

* cited by examiner

*Primary Examiner* — Cephia D Toomer
(74) *Attorney, Agent, or Firm* — Oblon, McClelland, Maier & Neustadt, L.L.P.

(57) ABSTRACT

A lubricating oil composition, containing a base oil (A) that satisfies the following requirements (A-1) to (A-4), and a polymer (B) that satisfies the following requirements (B-1) and (B-2): (A-1): a 100° C. kinematic viscosity is 2.0 $mm^2/s$ or more and less than 7.0 $mm^2/s$, (A-2): a viscosity index is 100 or more, (A-3): a content of cycloparaffin is 35.0% by volume or less based on a total volume of the base oil (A), (A-4): an aromatic content (% CA) is less than 1.0, (B-1): a ratio of a mass-average molecular weight (Mw) to a number-average molecular weight (Mn), [Mw/Mn] is 1.0 or more and less than 6.0, (B-2): a ratio of a peak integral value ($I_{10}$) at a chemical shift 10.0 to 11.0 ppm to a peak integral value ($I_{14}$) at a chemical shift 13.5 to 14.5 ppm, as determined in $^{13}C$-NMR analysis, [$I_{10}/I_{14}$] is 0.05 or more.

19 Claims, No Drawings

LUBRICANT COMPOSITION

CROSS REFERENCE TO RELATED APPLICATIONS

This application is a National Stage entry under 35 U.S.C. § 371 of PCT/JP2022/015456, filed on Mar. 29, 2022, and claims priority to Japanese Patent Application No. 2021-055697, filed on Mar. 29, 2021. The entire contents of both are incorporated herein by reference.

TECHNICAL FIELD

The present invention relates to a lubricating oil composition having a high viscosity index.

BACKGROUND ART

In recent years, lubricating oil compositions used as drive system oils such as automatic transmission fluids (ATF), continuously variable transmission fluids (CVTF) and shock absorber fluids (SAF), as well as internal engine oils and hydraulic fluids are required to have various characteristics depending on their uses.

For example, regarding fuel saving for automobiles, improvement of automobiles themselves such as body weight reduction and engine improvement, and also fuel saving improvement of lubricating oil such as viscosity reduction of lubricating oil and addition of various friction modifiers for preventing friction loss in drive system members, engines, and the like are important. However, the lubricating oil is used in a broad temperature range, and therefore mere viscosity reduction thereof causes various failures, for example, an oily film may be thin in the lubricating part under high temperature conditions so that members may come into contact with each other to increase friction and to cause seizure. Consequently, it is desirable that the viscosity of a lubricating oil does not change as much as possible in a broad temperature range. Specifically, a lubricating oil having a high viscosity index is desired.

Accordingly, for example, for a lubricating oil for use in a broader temperature range from a high-temperature range to a low-temperature range, generally employed is a method of improving the temperature dependence of viscosity thereof by adding a viscosity index improver. In addition, studies are also made from the side of a base oil for improving the fuel saving characteristics of a lubricating oil composition.

For example, PTL 1 discloses a lubricating oil composition that uses a mineral oil-based base oil satisfying specific requirements.

CITATION LIST

Patent Literature

PTL 1: JP 2018-100329 (A)

SUMMARY OF INVENTION

Technical Problem

As mentioned above, as a method for improving the temperature dependence of viscosity of a lubricating oil, use of various viscosity index improvers is investigated for improving the viscosity index of a lubricating oil composition, but further viscosity index improvement is required.

A viscosity index improver is used naturally by adding to a lubricant base oil, but heretofore, an influence of a combination of a lubricant base oil and a viscosity index improver on a viscosity index has not as yet been investigated sufficiently, and there is room for investigation for improving a viscosity index.

From such viewpoints, the present invention addresses an object of providing a lubricating oil composition having a high viscosity index.

Solution to Problem

As a result of assiduous studies, the present inventor has found that a lubricating oil composition containing a base oil (A) satisfying specific requirements and a polymer (B) satisfying specific requirements can solve the above-mentioned problems. The embodiments of the present invention have been completed based on such findings. Specifically, according to the embodiments of the present invention, there are provided the following [1] to [14].

[1] A lubricating oil composition, containing:

a base oil (A) that satisfies the following requirements (A-1) to (A-4); and a polymer (B) that satisfies the following requirements (B-1) and (B-2):

Requirement (A-1): 100° C. kinematic viscosity is 2.0 $mm^2/s$ or more and less than 7.0 $mm^2/s$.

Requirement (A-2): Viscosity index is 100 or more.

Requirement (A-3): Content of cycloparaffin, as measured according to ASTM D 2786-91(2016), is 35.0% by volume or less based on the total amount, 100% by volume of the base oil (A).

Requirement (A-4): % CA is less than 1.0.

Requirement (B-1): Ratio of the mass-average molecular weight (Mw) to the number-average molecular weight (Mn), [Mw/Mn] is 1.0 or more and less than 6.0.

Requirement (B-2): Ratio of the peak integral value ($I_{10}$) at a chemical shift 10.0 to 11.0 ppm to the peak integral value ($I_{14}$) at a chemical shift 13.5 to 14.5 ppm, as determined in $^{13}$C-NMR analysis, [$I_{10}/I_{14}$] is 0.05 or more.

[2] The lubricating oil composition according to the above [1], wherein the content of the base oil (A) is, based on the total amount, 100% by mass of the lubricating oil composition, 50.0% by mass or more and 99.9% by mass or less.

[3] The lubricating oil composition according to the above [1] or [2], wherein the base oil (A) is a base oil grouped in Group II or Group III in the API category.

[4] The lubricating oil composition of any of the above [1] to [3], wherein the base oil (A) further satisfies the following requirement (A-5):

Requirement (A-5): The content ratio of a monocyclic cycloparaffin content (R1) to the total of a dicyclic to hexa-cyclic cycloparaffin content (R2-6), [(R1)/(R2-6)], as measured according to ASTM D 2786-91(2016), is 1.0 or less by volume.

[5] The lubricating oil composition of any of the above [1] to [4], wherein the base oil (A) further satisfies the following requirement (A-6):

Requirement (A-6): The content of a tricyclic cycloparaffin (R3), as measured according to ASTM D 2786-91(2016), is less than 4.0% by volume based on the total amount, 100% by volume of the base oil (A).

[6] The lubricating oil composition of any of the above [1] to [5], wherein the ratio [$I_{10}/I_{14}$] of the component (B) is 0.05 or more and 5.00 or less.

[7] The lubricating oil composition of any of the above [1] to [6], wherein the content of the component (B) is 0.1% by mass or more and 30.0% by mass or less, based on the total amount, 100% by mass of the lubricating oil composition.

[8] The lubricating oil composition of any of the above [1] to [7], wherein the total content of the base oil (A) and the component (B) is 70.0% by mass or more and 100% by mass or less, based on the total amount, 100% by mass of the lubricating oil composition.

[9] The lubricating oil composition of any of the above [1] to [8], wherein the 100° C. kinematic viscosity is 1.0 $mm^2/s$ or more and 15.0 $mm^2/s$ or less.

[10] The lubricating oil composition of any of the above [1] to [9], wherein the viscosity index is 300 or more.

[11] A method for producing a lubricating oil composition, including blending a polymer (B) satisfying the following requirements (B-1) and (B-2) in a base oil (A) satisfying the following requirements (A-1) to (A-4):

Requirement (A-1): 100° C. kinematic viscosity is 2.0 $mm^2/s$ or more and less than 7.0 $mm^2/s$.

Requirement (A-2): Viscosity index is 100 or more.

Requirement (A-3): Content of cycloparaffin, as measured according to ASTM D 2786-91(2016), is 35.0% by volume or less based on the total amount, 100% by volume of the base oil (A).

Requirement (A-4): % CA is less than 1.0.

Requirement (B-1): Ratio of the mass-average molecular weight (Mw) to the number-average molecular weight (Mn), [Mw/Mn] is 1.0 or more and less than 6.0.

Requirement (B-2): Ratio of the peak integral value ($I_{10}$) at a chemical shift 10.0 to 11.0 ppm to the peak integral value ($I_{14}$) at a chemical shift 13.5 to 14.5 ppm, as determined in $^{13}$C-NMR analysis, [$I_{10}/I_{14}$] is 0.05 or more.

[12] A lubrication method using the lubricating oil composition of any of the above [1] to [10] or the lubricating oil composition obtained in the production method of the above [11].

[13] A drive system device using the lubricating oil composition of the above [1] to [10] or the lubricating oil composition obtained in the production method of the above [11].

[14] An internal combustion engine using the lubricating oil composition of the above [1] to [10] or the lubricating oil composition obtained in the production method of the above [11].

Advantageous Effects of Invention

According to the present invention, there can be provided a lubricating oil composition having a high viscosity index.

DESCRIPTION OF EMBODIMENTS

Hereinunder preferred embodiments of the present invention are described in detail.

[Lubricating Oil Composition]

The lubricating oil composition of one embodiment of the present invention contains a base oil (A) satisfying the following requirements (A-1) to (A-4) and a polymer (B) satisfying the following requirements (B-1) and (B-2):

Requirement (A-1): 100° ° C. kinematic viscosity is 2.0 $mm^2/s$ or more and less than 7.0 $mm^2/s$.

Requirement (A-2): Viscosity index is 100 or more.

Requirement (A-3): Content of cycloparaffin, as measured according to ASTM D 2786-91(2016), is 35.0% by volume or less based on the total amount, 100% by volume of the base oil (A).

Requirement (A-4): % CA is less than 1.0.

Requirement (B-1): Ratio of the mass-average molecular weight (Mw) to the number-average molecular weight (Mn), [Mw/Mn] is 1.0 or more and less than 6.0.

Requirement (B-2): Ratio of the peak integral value ($I_{10}$) at a chemical shift 10.0 to 11.0 ppm to the peak integral value ($I_{14}$) at a chemical shift 13.5 to 14.5 ppm, as determined in $^{13}$C-NMR analysis, [$I_{10}/I_{14}$] is 0.05 or more.

In the case where the lubricating oil composition does not contain the base oil (A) or the polymer (B), it is difficult to sufficiently improve the viscosity index.

Hereinafter, in the present description, the upper limit and the lower limit as stepwise described regarding the preferred numerical range (for example, the range of content), can be each independently combined. For example, from the description of a lower limit of "preferably 10 or more, more preferably 30 or more, even more preferably 40 or more", and the description of an upper limit of "preferably 90 or less, more preferably 80 or less, even more preferably 70 or less", a range of a combination of the lower limit and the upper limit each independently selected, for example, "10 or more and 70 or less", "30 or more and 70 or less", and "40 or more and 80 or less" can also be selected. Also from the same description, a range merely defining one of the lower limit or the upper limit, for example, "40 or more" or "70 or less" can also be selected. Also the same shall apply to the preferred range selectable from a description of, for example, "preferably 10 or more and 90 or less, more preferably 30 or more and 80 or less, even more preferably 40 or more and 70 or less", and "preferably 10 to 90, more preferably 30 to 80, even more preferably 40 to 70". In the present description, regarding the description of a numerical range, for example, an expression of "10 to 90" is the same as "10 or more and 90 or less".

In the present description, "a hydrocarbon group" means a group composed of a carbon atom and a hydrogen atom alone. The "hydrocarbon group" includes "an aliphatic group" composed of a linear or branched chain, "an alicyclic group" having one or more non-aromatic saturated or unsaturated carbon ring, and "an aromatic group" having one or more aromatic ring having aromaticity such as a benzene ring.

In the present description, "a ring carbon number" means a number of the carbon atoms of the atoms constituting the ring itself of a compound having a structure where the atoms ring-like bond to each other. In the case where the ring is substituted with a substituent, the carbon contained in the substituent is not included in the ring carbon number.

In the present invention, for example, "(meth)acrylate" indicates both "acrylate" and "methacrylate", and "a (meth) acryloyl group" indicates both "an acryloyl group" and "a methacryloyl group", and the same shall apply to the other similar terms.

The components contained in the lubricating oil composition are described below.

<Base Oil (A)>

The base oil (A) for use in the lubricating oil composition (hereinafter also referred to simply as "component (A)") is a base oil satisfying the following requirements (A-1) to (A-4).

Requirement (A-1): 100° C. kinematic viscosity is 2.0 $mm^2/s$ or more and less than 7.0 $mm^2/s$.

Requirement (A-2): Viscosity index is 100 or more.

Requirement (A-3): Content of cycloparaffin, as measured according to ASTM D 2786-91(2016), is 35.0% by volume or less based on the total amount, 100% by volume of the base oil (A).

Requirement (A-4): % CA is less than 1.0.

In the case where the base oil (A) is a mixed oil prepared by combining two or more base oils, the mixed oil may satisfy the above requirements.

(Requirement (A-1))

The requirement (A-1) is one defining the balance between the evaporation loss and the fuel economy improving effect of the base oil.

Specifically, when the 100° C. kinematic viscosity of the base oil (A) is less than 2.0 $mm^2/s$, the evaporation loss increases, and hence, such is not preferred. On the other hand, when the 100° C. kinematic viscosity of the base oil (A) is 7.0 $mm^2/s$ or more, the power loss to be caused due to viscosity resistance increases, and hence, such is problematic in terms of a fuel economy improving effect.

From the viewpoint of reducing the evaporation loss of the base oil (A), the 100° C. kinematic viscosity of the base oil (A) is preferably 2.1 $mm^2/s$ or more, more preferably 2.2 $mm^2/s$ or more, and still more preferably 2.5 $mm^2/s$ or more, and from the viewpoint of improving the fuel economy improving effect of the base oil (A), it is preferably 6.0 $mm^2/s$ or less, more preferably 5.5 $mm^2/s$ or less, still more preferably 5.0 $mm^2/s$ or less, and yet still more preferably 4.5 $mm^2/s$ or less.

As one embodiment of the base oil (A), the 100° C. kinematic viscosity of the base oil (A) is preferably 2.1 to 6.0 $mm^2/s$, more preferably 2.2 to 5.5 $mm^2/s$, even more preferably 2.5 to 5.0 $mm^2/s$, further more preferably 2.5 to 4.5 $mm^2/s$.

(Requirement (A-2))

The requirement (A-2) is a definition to be a base oil having good viscosity-temperature characteristics and fuel saving performance.

Specifically, when the viscosity index of the base oil (A) is less than 100, viscosity-temperature characteristics and fuel saving performance significantly worsen and hence, the lubricating composition using the base oil (A) has a problem in point of fuel efficiency.

From this viewpoint, the viscosity index of the base oil (A) is preferably 105 or more, more preferably 110 or more, even more preferably 115 or more.

The lubricating oil composition contains the base oil (A) and the polymer (B) to be mentioned below, and therefore even when the viscosity index of the base oil (A) itself is not relatively high, a lubricating oil composition having a high viscosity index can be provided.

Consequently, the upper limit of the viscosity index of the base oil (A) is not specifically limited, but the viscosity index of the base oil (A) is preferably 145 or less, more preferably 140 or less, even more preferably 135 or less.

As one embodiment of the base oil (A), the viscosity index of the base oil (A) is preferably 105 to 145, more preferably 110 to 140, even more preferably 115 to 135.

(Requirement (A-3))

As defined by the requirement (A-3), the base oil (A) for use in the present invention needs to have a content of cycloparaffin, as measured according to ASTM D 2786-91 (2016) and based on the total amount, 100% by volume of the base oil (A), of 35.0% by volume or less. The requirement (A-3) is a definition for improving the viscosity index of the resultant lubricating oil composition.

The lubricating oil composition containing the base oil (A) that satisfies the requirement (A-3) and the polymer (B) to be mentioned below can have an increased viscosity index as compared with a lubricating oil composition not containing any of the components. Specifically, a lubricating oil composition containing the polymer (B) to be mentioned below but not containing the base oil (A) satisfying the requirement (A-3) could not have a sufficiently increased viscosity index.

From this viewpoint, the content of cycloparaffin in the base oil (A) is, based on the total amount, 100% by mass of the base oil (A), preferably 34.0% by mass or less, more preferably 33.0% by mass or less, even more preferably 32.0% by mass or less.

The lower limit of the content of cycloparaffin in the base oil (A) is not specifically limited, but the cycloparaffin content is, for example, preferably 0.1% by volume or more, more preferably 1.0% by volume or more, even more preferably 2.0% by volume or more.

As one embodiment of the base oil (A), the content of cycloparaffin in the base oil (A) is preferably 0.1 to 34.0% by volume, more preferably 1.0 to 33.0% by volume, even more preferably 2.0 to 32.0% by volume.

The "content of cycloparaffin" (hereinafter also referred to as "cycloparaffin content") means a proportion of a molecule having a cycloparaffin skeleton, and a monocyclic cycloparaffin content such as cyclopentane or cyclohexane, or one formed by bonding or condensation of two or more rings of these monocyclic cycloparaffins corresponds thereto.

In the cycloparaffin content, those where hydrogen atoms bonding to the ring carbon atoms constituting the cyclic structure are substituted with various substituents, are included.

In the cycloparaffin content, an unsaturated alicyclic compound containing a double bond in the cyclic structure, such as cyclopentene or cyclohexene, is contained, but an aromatic compound is not contained.

Specifically, the cycloparaffin content is a content of cycloparaffin measured according to the method described in Examples given hereinafter.

(Requirement (A-4))

As defined by the requirement (A-4), the base oil (A) for use in the present invention needs to have an aromatic content (% CA) of less than 1.0. A lubricating oil composition that contains a base oil (A) having an aromatic content (% CA) of 1.0 or more is unfavorable, for example, in point of high-temperature detergency.

From the above-mentioned viewpoint, the aromatic content (% CA) in the base oil (A) is preferably 0.3 or less, more preferably 0.1 or less, even more preferably 0.01 or less.

Accordingly, the aromatic content (% CA) in the base oil (A) is preferably 0 or more and less than 1.0, more preferably 0 to 0.3, more preferably 0 to 0.1, even more preferably 0 to 0.01.

Here, the aromatic content (% CA) indicates a proportion (percentage) of the aromatic content calculated according to a ring analysis n-d-M method, and is specifically a value measured according to the method described in Examples to be given hereinafter.

(Requirement (A-5))

Preferably, the base oil (A) for use in the lubricating oil composition further satisfies the following requirement (A-5).

Requirement (A-5): The content ratio of the monocyclic cycloparaffin content (R1) to the total of the dicyclic to hexa-cyclic cycloparaffins content (R2-6), [(R1)/(R2-6)], as measured according to ASTM D 2786-91(2016), is 1.0 or less by volume.

The base oil (A) satisfying the requirement (A-5) is preferred from the viewpoint of improving the viscosity index.

From the above-mentioned viewpoint, the content ratio [(R1)/(R2-6)] in the base oil (A) is, by volume ratio, preferably 0.8 or less, more preferably 0.7 or less.

Also the content ratio [(R1)/(R2-6)] is preferably 0.01 or more, more preferably 0.1 or more, even more preferably 0.3 or more.

As one embodiment of the base oil (A), the content ratio [(R1)/(R2-6)] in the base oil (A) is, by volume ratio, preferably 0.01 to 1.0, more preferably 0.1 to 0.8, even more preferably 0.3 to 0.7.

Also as one embodiment of the base oil (A), for example, from the viewpoint of improving the viscosity index, the monocyclic cycloparaffin content (R1) in the base oil (A) as measured according to ASTM D 2786-91(2016) is, based on the total amount, 100% by volume of the base oil (A), preferably 30.0% by volume or less, more preferably 0.1 to 20.0% by volume, even more preferably 1.0 to 13.0% by volume.

Also as one embodiment of the base oil (A), for example, from the viewpoint of improving the viscosity index, the total of the dicyclic to hexa-cyclic cycloparaffins content (R2-6) in the base oil (A) as measured according to ASTM D 2786-91(2016) is, based on the total amount, 100% by volume of the base oil (A), preferably 0.1 to 25.0% by volume, more preferably 0.1 to 24.0% by volume, even more preferably 1.0 to 23.0% by volume.

Also as one embodiment of the base oil (A), for example, from the viewpoint of improving the viscosity index, the content of the acyclic cycloparaffin content (R0) in the base oil (A) as measured according to ASTM D 2786-91(2016) is, based on the total amount, 100% by volume of the base oil (A), preferably 60.0 to 100.0% by volume, more preferably 60.0 to 98.0% by volume, even more preferably 65.0 to 90.0% by volume.

(Requirement (A-6))

Also preferably, the base oil (A) for use in the lubricating oil composition further satisfies the following requirement (A-6).

Requirement (A-6): The content of the tricyclic cycloparaffin (R3), as measured according to ASTM D 2786-91(2016), is less than 4.0% by volume based on the total amount, 100% by volume of the base oil (A).

The base oil (A) satisfying the requirement (A-6) is preferred from the viewpoint of improving the viscosity index.

From the above viewpoint, the content of the tricyclic cycloparaffin (R3) in the base oil (A) is more preferably 3.8% by volume or less, even more preferably 3.5% by volume or less.

As one embodiment of the base oil (A), the content of the tricyclic cycloparaffin (R3) in the base oil (A) is, based on the total amount, 100% by volume of the base oil (A), preferably 0% by volume or more and less than 4.0% by volume, more preferably 0 to 3.8% by volume, even more preferably 0 to 3.5% by volume.

The content of the base oil (A) is, from the viewpoint of improving the viscosity index and based on the total amount, 100% by mass of the lubricating oil composition, preferably 50.0% by mass or more, more preferably 60.0% by mass or more, even more preferably 70.0% by mass or more, further more preferably 80.0% by mass or more, and is preferably 99.9% by mass or less, more preferably 99.5% by mass or less, even more preferably 99.0% by mass or less, further more preferably 98.0% by mass or less, further more preferably 97.5% by mass or less.

As one embodiment of the lubricating oil composition, the content of the base oil (A) is, based on the total amount, 100% by mass of the lubricating oil composition, preferably 50.0 to 99.9% by mass, more preferably 60.0 to 99.5% by mass, even more preferably 70.0 to 99.0% by mass, further more preferably 80.0 to 98.0% by mass, further more preferably 80.0 to 97.5% by mass.

Examples of the feedstock for the base oil (A) include atmospheric residues obtained through atmospheric distillation of crude oils such as paraffin-based crude oils, intermediate-based crude oils and naphthene-based crude oils; lubricating oil fractions obtained through reduced-pressure distillation of such atmospheric residues and mineral oil-based waxes; and residual waxes in a GTL process (gas-to-liquid wax, hereinafter also referred to as "GTL wax").

Examples of the base oil (A) include oils produced by purification of the above-mentioned lubricating oil fractions by one or more, preferably all of the following treatments: a solvent deasphalting; at least one kind of a treatment of a solvent extraction or a hydrocracking; at least one kind of a dewaxing treatment of a solvent dewaxing or a catalytic dewaxing; a hydrorefining; and the like, oils produced by isomerizing the above-mentioned mineral oil-based waxes, and GTL base oils produced by a process of hydroisomerization dewaxing of the GTL waxes.

The base oil (A) is more preferably at least one selected from the base oil grouped in Group II and the base oil grouped in Group III in the base oil category by American Petroleum Institute (API), more preferably the base oil grouped in Group III.

In one embodiment of the present invention, one kind alone or two or more kinds of the above-mentioned base oils can be used either singly or as combined, as the base oil (A).

Preparation Example for Base Oil (A) Satisfying the Requirements (A-1) to (A-4)

Embodiment of the base oil (A) and the feedstock for the base oil include those mentioned hereinabove. The base oil (A) satisfying the requirements (A-1) to (A-4) can be prepared, for example, by appropriately taking the following matters into consideration. The following matters are examples of a preparation method for the base oil (A), and the base oil can also be prepared in consideration of any other matters than these.

One embodiment of the base oil (A) is preferably obtained by purifying a feedstock oil. The feedstock oil is, from the viewpoint of producing a base oil satisfying the above-mentioned requirements, preferably a feedstock oil containing a petroleum-derived wax, as well as a feedstock oil containing a petroleum-derived wax and a bottom oil. A feedstock oil containing a solvent-dewaxed oil can also be used.

In the case where a feedstock oil containing a petroleum-derived wax and a bottom oil is used, the content ratio of the wax to the bottom oil in the feedstock oil (wax/bottom oil) is, from the viewpoint of producing a base oil satisfying the requirements mentioned above, preferably, as a ratio by mass, 55/45 to 95/5, more preferably 70/30 to 95/5, even more preferably 80/20 to 95/5.

As the bottom oil, there is exemplified a bottom fraction having remained after hydrocracking of an oil including a heavy fuel oil obtained from a reduced-pressure distillation unit in a common fuel oil producing process using a crude oil as a feedstock, followed by separation and removal of naphtha and a kerosene-gas oil.

Examples of the wax include, in addition to the wax separated by solvent dewaxing of the aforementioned bottom fraction, a wax obtained by subjecting a crude oil, such as a paraffin-based oil, an intermediate-based crude oil, or a naphthene-based crude oil to atmospheric distillation, and separating and removing naphtha and light kerosene, followed by solvent dewaxing of the remaining atmospheric residues; a wax obtained by solvent dewaxing of a distillate obtained by subjecting the atmospheric residues to distillation under reduced pressure; a wax obtained by solvent dewaxing of a product obtained by subjecting the distillate to solvent deasphalting, solvent extraction, or hydrofinishing; and a GTL wax obtained by Fischer-Tropsch synthesis.

On the other hand, as the solvent dewaxed oil, there is exemplified a residue after solvent dewaxing of the aforementioned bottom fraction, followed by separation and removal of the wax. In addition, the solvent dewaxed oil is one having been subjected to a purification process by solvent dewaxing and is different from the aforementioned bottom oil.

The method for obtaining a wax through solvent dewaxing is preferably a method in which, for example, the bottom fraction is mixed with a mixed solvent of methyl ethyl ketone and toluene, and the precipitate is removed while agitating the mixture in a low-temperature environment.

From the viewpoint of producing a base oil satisfying the above-mentioned requirements, a specific temperature in the solvent dewaxing in a low-temperature environment is preferably lower than the typical solvent dewaxing temperature. Specifically, the temperature is preferably −25° C. or lower, and more preferably −30° C. or lower.

From the viewpoint of producing a base oil satisfying the above-mentioned requirements, the content of an oil component of the feedstock oil is preferably 5 to 55% by mass, more preferably 7 to 45% by mass, still more preferably 10 to 35% by mass, yet still more preferably 15 to 32% by mass, and especially preferably 21 to 30% by mass.

From the viewpoint of producing a base oil satisfying the requirement (A-1), the kinematic viscosity at 100° C. of the feedstock oil is preferably 2.0 to 7.0 $mm^2/s$, more preferably 2.3 to 6.5 $mm^2/s$, and still more preferably 2.5 to 6.0 $mm^2/s$.

From the viewpoint of producing a base oil satisfying the above-mentioned requirements, the viscosity index of the feedstock oil is preferably 100 or more, more preferably 110 or more, and still more preferably 120 or more.

(Setting of Purification Conditions for Feedstock Oil)

Preferably, the feedstock oil is subjected to a purification process to prepare a base oil satisfying the above-mentioned requirements.

Preferably, the purification process includes at least one of a hydroisomerization dewaxing process and a hydrogenation process. Preferably, the type of the purification process and the purification conditions are appropriately set according to the kind of the feedstock oil to be used. More specifically, from the viewpoint of producing a base oil satisfying the above-mentioned requirements, purification treatment is selected as follows, depending on the kind of the feedstock oil to be used.

In the case of using a feedstock oil (a1) containing a petroleum-derived wax and a bottom oil in the foregoing content ratio, it is preferred that the feedstock oil (a1) is subjected to a purification process including both a hydroisomerization dewaxing process and a hydrogenation process.

In the case of using a feedstock oil (a2) containing a solvent dewaxed oil, it is preferred that the feedstock oil (a2) is subjected to a purification process including a hydrogenation process but not to a hydroisomerization dewaxing process.

The feedstock oil (a1) contains a bottom oil, and therefore, the contents of aromatic, sulfur, and nitrogen components tend to increase, but it is possible to remove the aromatic component, the sulfur component, and the nitrogen component by hydroisomerization dewaxing treatment to thereby reduce the content of these components.

In hydroisomerization dewaxing treatment, a linear-chain paraffin in the wax is isomerized into a branched chain isoparaffin, and therefore through the treatment, a base oil satisfying the above-mentioned requirements can be readily prepared.

Along with the hydroisomerization dewaxing treatment, an aromatic component is ring-cleaved to be converted into a paraffin component, whereby the aromatic content (% $C_A$) can be decreased to facilitate easy preparation of a base oil satisfying the above-mentioned requirements.

On the other hand, though the feedstock oil (a2) contains a wax, a linear paraffin is separated and removed through precipitation in a low-temperature environment in a solvent dewaxing process, and therefore, the content of the linear paraffin that affects the values of the above-mentioned requirements is small. Accordingly, there is less need to perform the "hydroisomerization dewaxing treatment".

(Hydroisomerization Dewaxing Process)

The hydroisomerization dewaxing process is, as mentioned above, a purification process that is performed for purposes of isomerizing the linear paraffin contained in the feedstock oil into a branched-chain isoparaffin, ring-cleaving the aromatic component to be converted into a paraffin component, and removing impurities such as a sulfur component and a nitrogen component. The hydroisomerization dewaxing treatment is preferably carried out in the presence of a hydroisomerization dewaxing catalyst.

Examples of the hydroisomerization dewaxing catalyst include catalysts with a metal oxide such as nickel (Ni)/tungsten (W), nickel (Ni)/molybdenum (Mo), or cobalt (Co)/molybdenum (Mo), or a noble metal, such as platinum (Pt), or lead (Pd), supported on a carrier, such as silica aluminophosphate (SAPO), or zeolite.

From the viewpoint of producing a base oil satisfying the above-mentioned requirements, a hydrogen partial pressure in the hydroisomerization dewaxing process is preferably 2.0 to 220 MPa, more preferably 2.5 to 100 MPa, still more preferably 3.0 to 50 MPa, and yet still more preferably 3.5 to 25 MPa.

From the viewpoint of producing a base oil satisfying the above-mentioned requirements, a reaction temperature in the hydroisomerization dewaxing process is preferably set to a temperature higher than the reaction temperature of a common hydroisomerization dewaxing process, and specifically, it is preferably 320 to 480° C., more preferably 325 to 420° C., still more preferably 330 to 400° C., even more preferably 340 to 370° C. When the reaction temperature is a high temperature, the isomerization of the linear paraffin existent in the feedstock oil into a branched-chain isoparaffin can be promoted, whereby it becomes easy to prepare a base oil satisfying the above-mentioned requirements.

From the viewpoint of producing a base oil satisfying the above-mentioned requirements, a liquid hourly space velocity (LHSV) in the hydroisomerization dewaxing process is preferably 5.0 $hr^{-1}$ or less, more preferably 2.0 $hr^{-1}$ or less, still more preferably 1.0 $hr^{-1}$ or less, and yet still more preferably 0.6 $hr^{-1}$ or less.

From the viewpoint of improving the productivity, the LHSV in the hydroisomerization dewaxing process is preferably 0.1 $hr^{-1}$ or more, and more preferably 0.2 $hr^{-1}$ or more.

A supply proportion of the hydrogen gas in the hydroisomerization dewaxing process is preferably 100 to 1,000 $Nm^3$, more preferably 200 to 800 $Nm^3$, and still more preferably 250 to 650 $Nm^3$ per kiloliter of the feedstock oil to be supplied.

The generated oil after the hydroisomerization dewaxing process can be subjected to reduced-pressure distillation for the purpose of removing the light fraction.

(Hydrogenation Process)

The hydrogenation process is a purification process that is performed for the purpose including of complete saturation of the aromatic component contained in the feedstock oil, and removal of impurities such as the sulfur component and the nitrogen component.

Preferably, the hydrogenation process is performed in the presence of a hydrogenation catalyst.

Examples of the hydrogenation catalyst include catalysts with a metal oxide such as nickel (Ni)/tungsten (W), nickel (Ni)/molybdenum (Mo), cobalt (Co)/molybdenum (Mo), or a noble metal such as platinum (Pt), or lead (Pd), supported on an amorphous carrier such as silica/alumina, alumina, or a crystalline carrier such as zeolite.

From the viewpoint of producing a base oil satisfying the above-mentioned requirements, a hydrogen partial pressure in the hydrogenation process is preferably set to a pressure higher than the pressure of a common hydrogenation process, and specifically, it is preferably 16 MPa or more, more preferably 17 MPa or more, and still more preferably 20 MPa or more, and it is preferably 30 MPa or less, and more preferably 22 MPa or less.

From the viewpoint of producing a base oil satisfying the above-mentioned requirements, a reaction temperature in the hydrogenation process is preferably 200 to 400° C., more preferably 250 to 350° C., and still more preferably 280 to 330° C.

From the viewpoint of producing a base oil satisfying the above-mentioned requirements, a liquid hourly space velocity (LHSV) in the hydrogenation process is preferably 5.0 $hr^{-1}$ or less, more preferably 2.0 $hr^{-1}$ or less, and still more preferably 1.0 $hr^{-1}$ or less, and from the viewpoint of productivity, it is preferably 0.1 $hr^{-1}$ or more, more preferably 0.2 $hr^{-1}$ or more, and still more preferably 0.3 $hr^{-1}$ or more.

A supply proportion of the hydrogen gas in the hydrogenation process is preferably 100 to 1,000 $Nm^3$, more preferably 200 to 800 $Nm^3$, and still more preferably 250 to 650 $Nm^3$ per kiloliter of the supplied oil as a targeted subject.

The generated oil after the hydrogenation process may be subjected to reduced-pressure distillation for the purpose of removing the light fraction. Various conditions of the reduced-pressure distillation (e.g., pressure, temperature, time) are appropriately adjusted so as to make the kinematic viscosity at 100° C. of the base oil fall within a desirable range.

<Polymer (B)>

The polymer (B) for use in the lubricating oil composition (hereinafter this may be simply referred to as "component (B)") is a polymer satisfying the following requirements (B-1) and (B-2).

Requirement (B-1): Ratio of the mass-average molecular weight (Mw) to the number-average molecular weight (Mn), [Mw/Mn] is 1.0 or more and less than 6.0.

Requirement (B-2): Ratio of the peak integral value ($I_{10}$) at a chemical shift 10.0 to 11.0 ppm to the peak integral value ($I_{14}$) at a chemical shift 13.5 to 14.5 ppm, as determined in $^{13}C$-NMR analysis, [$I_{10}/I_{14}$] is 0.05 or more.

(Requirement (B-1))

When the ratio [Mw/Mn] defined by the requirement (B-1) is 1.0 or more, it is advantageous in point of improving the viscosity index. On the other hand, when the ratio [Mw/Mn] is generally less than 6.0.

From the above viewpoint, the ratio [Mw/Mn] of the component (B) is preferably 1.2 or more, more preferably 1.5 or more, even more preferably 1.8 or more, and is preferably 5.5 or less, more preferably 5.0 or less, even more preferably 3.0 or less.

As one embodiment of the component (B), the ratio [Mw/Mn] of the component (B) is preferably 1.2 to 5.5, more preferably 1.5 to 5.5, even more preferably 1.5 to 5.0, further more preferably 1.8 to 3.0.

From the viewpoint of improving the viscosity index, the mass-average molecular weight (Mw) of the component (B) is preferably 1,000 or more, more preferably 5,000 or more, even more preferably 20,000 or more, further more preferably 100,000 or more, and is preferably 1,000,000 or less, more preferably 900,000 or less, even more preferably 800,000 or less, further more preferably 700,000 or less.

As one embodiment of the component (B), the mass-average molecular weight (Mw) of the component (B) is preferably 1,000 to 1,000,000, more preferably 5,000 to 900,000, even more preferably 20,000 to 800,000, further more preferably 100,000 to 700,000.

In the present description, the mass-average molecular weight (Mw) and the number-average molecular weight (Mn) of the components are standard polyethylene-equivalent values measured according to a gel permeation chromatograph (GPC) method, and specifically mean the values measured according to the method described in Examples.

(Requirement (B-2))

As defined by the requirement (B-2), the component (B) for use in the present invention need to be such that the ratio of the peak integral value ($I_{10}$) at a chemical shift 10.0 to 11.0 ppm to the peak integral value ($I_{14}$) at a chemical shift 13.5 to 14.5 ppm thereof, as determined in $^{13}C$-NMR analysis, [$I_{10}/I_{14}$] is 0.05 or more. The requirement (B-2) is a requirement necessary for improving the viscosity index of the resultant lubricating oil composition.

Accordingly, as compared with the lubricating oil composition of one embodiment of the present invention, for example, a lubricating oil composition not containing the component (B) but containing a polymer that does not satisfy the requirement (B-2) cannot improve the viscosity index up to a desired value.

Also the lubricating oil composition of one embodiment of the present invention contains the base oil (A) mentioned above and the polymer (B) satisfying the requirement (B-2) can have an increased viscosity index as compared with a lubricating composition not containing any of these components. Specifically, a lubricating oil composition containing the base oil (A) but not containing the component (B) that satisfies the requirement (B-2) cannot increase the viscosity index up to a desired value.

From this viewpoint, the ratio [$I_{10}/I_{14}$] of the component (B) is preferably 0.06 or more, more preferably 0.08 or more, even more preferably 0.10 or more.

Also the ratio $[I_{10}/I_{14}]$ of the component (B) is, from the viewpoint of improving the viscosity index, preferably 5.00 or less, more preferably 2.50 or less, even more preferably 2.00 or less, further more preferably 1.00 or less, further more preferably 0.60 or less.

As one embodiment of the component (B), the ratio $[I_{10}/I_{14}]$ of the component (B) is preferably 0.05 to 5.00, more preferably 0.06 to 5.00, even more preferably 0.08 to 2.50, further more preferably 0.08 to 2.00, further more preferably 0.10 to 1.00, further more preferably 0.10 to 0.60.

Here, the peak at a chemical shift 10.0 to 11.0 ppm as determined in 13C-NMR analysis indicates that the polymer has a side chain having a high molecular weight derived from a macromonomer to be mentioned below, and has a carbon atom of a terminal methyl group of an alkyl chain further branched from the high-molecular-weight side chain, and the peak integral value ($I_{10}$) thereof represents a proportion of the carbon atom of the terminal methyl group contained in all the carbon atoms in the polymer molecule.

In the present description, the "macromonomer" means a high-molecular-weight monomer having a polymerizable functional group. Examples of the polymerizable functional group include a methacryloyl group, an acryloyl group, an ethenyl group, a vinyl ether group, and an allyl group, and among these, preferred is a methacryloyl group or an acryloyl group, and more preferred is a methacryloyl group.

In the present description, the partial structure derived from the high-molecular-weight chain in the macromonomer in the polymer is a side chain in the polymer even when the partial structure has a high molecular weight. Specifically, as mentioned above, the partial structure may be referred to as "high-molecular-weight side chain".

The peak at a chemical shift 13.5 to 14.5 ppm as determined in $^{13}$C-NMR analysis indicates that the polymer has a side chain that is not a branched structure having a linear alkyl group with 4 or more carbon atoms, and has a carbon atom of a terminal methyl group of a linear alkyl group with 4 or more carbon atoms that the side chain has, and the peak integral value ($I_{14}$) thereof represents a proportion of the carbon atom of the terminal methyl group of the linear alkyl group with 4 or more carbon atoms contained in all the carbon atoms in the polymer molecule.

Accordingly, the ratio $[I_{10}/I_{14}]$ is, for example, when the amount of the carbon atom relating to ($I_{14}$) is constant, increased by increasing the amount of the carbon atom relating to ($I_{10}$), and is decreased by decreasing the amount of the carbon atom relating to ($I_{10}$). On the other hand, when the amount of the carbon atom relating to ($I_{10}$) is constant, the ratio is decreased by increasing the amount of the carbon atom relating to ($I_{14}$), and is increased by decreasing the amount of the carbon atom relating to ($I_{14}$).

Specifically, regarding the monomers to constitute the component (B), by increasing or decreasing the amount of the monomers to form the corresponding carbon atoms, the ratio $[I_{10}/I_{14}]$ can be controlled.

From the viewpoint of improving the viscosity index, in the component (B), the content of the structural unit ($p_{10}$) that contains the carbon atom relating to the peak at the chemical shift 10.0 to 11.0 ppm is, based on the total amount 100 mol % of the structural units constituting the component (B), preferably 0.1 mol % or more, more preferably 0.5 mol % or more, even more preferably 0.7 mol % or more, and is preferably 10.0 mol % or less, more preferably 5.0 mol % or less, even more preferably 2.5 mol % or less.

Also from the viewpoint of improving the viscosity index, in the component (B), the content ($p_{14}$) of the structural unit that contains the carbon atom relating to the peak at the chemical shift 13.5 to 14.5 ppm is, based on the total amount 100 mol % of the structural units constituting the component (B), preferably 50.0 mol % or more, more preferably 80.0 mol % or more, even more preferably 90.0 mol % or more, and is preferably 99.9 mol % or less, more preferably 99.5 mol % or less, even more preferably 99.0 mol % or less.

The total content of the structural units ($p_{10}$) and ($p_{14}$) in the component (B) is, based on the total amount 100 mol % of the structural units constituting the component (B), preferably 50.0 mol % or more, more preferably 80.0 mol % or more, even more preferably 90.0 mol % or more, and is preferably 100 mol % or less.

Regarding the content of the structural units, "the total amount 100 mol % of the structural units constituting the component (B)" indicates the total amount of the structural units derived from the monomers, not containing the structural units derived from a polymerization initiator and a chain transfer agent. In addition, this can be calculated, for example, from the blending ratio of the monomers to be feedstocks for the constituent structural units. When it is determined whether or not the polymer present in the lubricating oil composition satisfies the above-mentioned structure, for example, the polymer component is taken out from the lubricating oil composition by rubber film separation, and the polymer component is analyzed by $^{13}$C-NMR to identify the feedstock-derived structural units, and further it can be determined according to a method of confirming the content of each structural unit through pyrolysis GC-FID.

The component (B) can be any polymer satisfying the requirements (B-1) and (B-2), and is, for example, preferably a polyalkyl (meth)acrylate polymer containing an alkyl (meth)acrylate-derived structural unit (hereinafter also referred to as "PMA polymer").

In the case where the component (B) is a copolymer, the configuration of the copolymer can be, for example, any of a random addition polymer, an alternate copolymer, a graft copolymer of a block copolymer.

Regarding the structure of the component (B), the polymer can be a polymer having a specific structure, such as a polymer having a structure that has a large number of three-way branch points from which a high-molecular-weight side chain comes out in the main chain thereof (hereinafter also referred to as "comb-shaped polymer"), or a star-shaped polymer having a structure in which three or more chain-like polymers bond in one point, a type of a branched polymer.

The component (B) can contain a comb-shaped polymer as mentioned above. The comb-shaped polymer is, for example, preferably a polymer that contains at least a structural unit derived from a polymerizable functional group-having macromonomer mentioned above. Here, the structural unit corresponds to the above-mentioned "high-molecular weight side chain".

More specifically, the component (B) is preferably a copolymer having a side chain that contains a structural unit derived from the above-mentioned, polymerizable functional group-having macromonomer, relative to the main chain that contains a structural unit derived from various vinyl monomers, such as alkyl (meth)acrylates, nitrogen atom-containing monomers, halogen element-containing monomers, hydroxy group-containing monomers, aliphatic hydrocarbons, alicyclic hydrocarbons or aromatic hydrocarbons.

The number-average molecular weight (Mn) of the macromonomer is preferably 200 or more, more preferably 300 or more, even more preferably 400 or more, and is preferably 100,000 or less, more preferably 50,000 or less, even more preferably 10,000 or less.

The component (B) is, as mentioned above, a polymer having a partial structure relating to a peak at the chemical shift of 10.0 to 11.0 ppm and a partial structure relating to a peak at the chemical shift of 13.5 to 14.5 ppm.

In the component (B), examples of the monomer constituting the partial structure relating to a peak at the chemical shift of 10.0 to 11.0 ppm include a macromonomer (α). Preferably, the macromonomer (α) has a (meth)acryloyl group at one terminal and has a structural unit derived from a monomer (α1) selected from butadiene and hydrogenated butadiene.

Specifically, in the macromonomer (α), it is preferable that the polymer having a structural unit derived from the monomer (α1) corresponds to the above-mentioned "high-molecular-weight side chain". In addition, as mentioned above, it is preferable that the main chain of the component (B) has a structural unit derived from the polymerizable functional group that the macromonomer (α) has, and has a structural unit derived from a (meth)acryloyl group, more preferably has a structure derived from a methacryloyl group.

The number-average molecular weight (Mn) of the macromonomer (α) is preferably 300 or more, more preferably 500 or more, even more preferably 1,000 or more, further more preferably 2,000 or more, further more preferably 4,000 or more, and is preferably 100,000 or less, more preferably 50,000 or less, even more preferably 20,000 or less, further more preferably 10,000 or less.

The macromonomer (α) can have one or more repeating units represented by, for example, the following general formulae (c-i) to (c-iii), in addition to the structural unit derived from the monomer (α1).

(c-i)

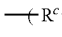

(c-ii)

(c-iii)

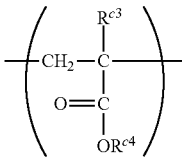

In the general formula (c-i), $R^{c1}$ represents a linear alkylene or branched alkylene group having 1 to 10 carbon atoms. Specifically, it includes a methylene group, an ethylene group, a 1,2-propylene group, a 1,3-propylene group, a pentylene group, a hexylene group, a heptylene group, an octylene group, a nonylene group, a decylene group, and a 2-ethylhexylene group.

In the general formula (c-ii), $R^{c2}$ represents a linear alkylene or branched alkylene group having 2 to 4 carbon atoms. Specifically, it includes an ethylene group, a 1,2-propylene group, a 1,3-propylene group, a 1,2-butylene group, a 1,3-butylene group, and a 1,4-butylene group.

In the general formula (c-iii), $R^{c3}$ represents a hydrogen atom or a methyl group.

$R^{c4}$ represents a linear or branched alkyl group having 1 to 10 carbon atoms. Specifically, it includes a methyl group, an ethyl group, an n-propyl group, an n-butyl group, an n-pentyl group, an n-hexyl group, an n-heptyl group, an n-octyl group, an n-nonyl group, an n-decyl group, an isopropyl group, an isobutyl group, a sec-butyl group, a tert-butyl group, an isopentyl group, a tert-pentyl group, an isohexyl group, a tert-hexyl group, an isoheptyl group, a tert-heptyl group, a 2-ethylhexyl group, an isooctyl group, an isononyl group, and an isodecyl group.

In the case where the macromonomer has plural repeating units represented by the general formulae (c-i) to (c-iii), $R^{c1}$'s, $R^{c2}$'s, $R^{c3}$'s and $R^{c4}$'s therein each can be the same as or different from each other.

In the case where the macromonomer (α) is a copolymer, the copolymerization form can be a block copolymer or a random copolymer.

The content of the macromonomer (α)-derived structural unit in the component (B) is, based on the total amount 100 mol % of the structural units constituting the component (B), preferably 0.1 mol % or more, more preferably 0.5 mol % or more, even more preferably 0.7 mol % or more, and is, from the viewpoint of improving the viscosity index, preferably 10.0 mol % or less, more preferably 5.0 mol % or less, even more preferably 2.5 mol % or less.

One kind alone or two or more kinds of macromonomer (α)-derived structural units can be contained in the component (B).

Preferably, the component (B) contains a macromonomer (α)-derived structural unit and a structural unit derived from a monomer (m1) represented by the following general formula (b1).

(b1)

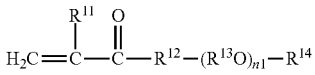

In the general formula (b1), $R^{11}$ represents a hydrogen atom or a methyl group.

$R^{12}$ represents a single bond, —O— or —NH—.

$R^{13}$ represents a linear alkylene or branched alkylene group having 2 to 4 carbon atoms. n1 represents an integer of 0 to 20. When n1 is an integer of 2 or more, plural $R^{13}$'s can be the same or different, and the $(R^{13}O)_{n1}$ moiety can be in random copolymerization or block copolymerization.

$R^{14}$ represents an acyclic alkyl having 4 to 9 carbon atoms, or a group having a cyclic alkyl group and having 6 to 8 carbon atoms.

However, a case where n1 is an integer of 1 to 20 and $R^{14}$ is an acyclic alkyl group having 4 or 5 carbon atoms is excluded.

As mentioned above, among the monomer (m1) represented by the general formula (b1), a monomer where $R^{14}$ is a linear alkyl group having 4 to 9 carbon atoms corresponds to the monomer that constitutes a partial structure relating to a peak of the chemical shift 13.5 to 14.5 pm in the component (B).

In the general formula (b1), $R^{14}$ is preferably an acyclic alkyl group having 4 or 5 carbon atoms, or a group having a cyclic alkyl group and having 6 to 8 carbon atoms. The carbon number of the group having a cyclic alkyl group means a total number of the carbon atoms contained in the cyclic alkyl group-having group.

Specific examples of the acyclic alkyl group having 4 or 5 carbon atoms include an n-butyl group, an isobutyl group, a sec-butyl group, a tert-butyl group, an n-pentyl group, a neopentyl group, an isopentyl group, a sec-pentyl group, a tert-pentyl group and a 3-pentyl group. Among these, preferred is an n-butyl group or an n-pentyl group, and more preferred is an n-butyl group.

Specific examples of the group having a cyclic alkyl group and having 6 to 8 carbon atoms include a cyclohexyl group, a methylcyclohexyl group, an ethylcyclohexyl group, a dimethylcyclohexyl group, a cyclohexylmethyl group, a methylcyclohexylmethyl group, and a cyclohexylethyl group.

In the general formula (b1), $R^{11}$ is preferably a methyl group.

$R^{12}$ is preferably —O—.

From the same viewpoint, $R^{13}$ is preferably a linear alkylene group having 2 to 3 carbon atoms, more preferably an ethylene group.

Specifically, the monomer (m1) preferably has an acryloyl group or a methacryloyl group as a polymerizable functional group, and more preferably has a methacryloyl group.

Also preferably, n1 is 0 to 5, more preferably 0 to 2, even more preferably 0.

Specifically, the monomer (m1) is preferably an n-butyl methacrylate.

In the component (B), the content of the structural unit derived from the monomer (m1) is, from the viewpoint of improving the viscosity index and based on the total amount, 100 mol % of the structural units constituting the component (B), preferably 50.0 mol % or more, more preferably 60.0 mol % or more, even more preferably 65.0 mol % or more, further more preferably 70.0 mol % or more, further more preferably 72.0 mol % or more, further more preferably 73.0 mol % or more, and is preferably 99.9 mol % or less, more preferably 98.0 mol % or less, even more preferably 95.0 mol % or less, further more preferably 94.0 mol % or less, further more preferably 93.0 mol % or less, further more preferably 92.0 mol % or less.

The structural unit derived from the monomer (m1) in the component (B) can be one kind alone or two or more kinds.

Preferably, the component (B) contains a structural unit derived from a monomer (m2), an alkyl (meth)acrylate having a linear alkyl group with 10 to 30 carbon atoms or a branched alkyl group with 10 to 30 carbon atoms. When the component (B) further contains a structural unit derived from a monomer (m2), solubility in the base oil can be more readily improved, and the advantageous effects of the present invention can be therefore more readily exerted.

The monomer (m2) is preferably an alkyl methacrylate.

The carbon number of the alkyl group that the monomer (m2) has is preferably 10 to 24, more preferably 11 to 22, even more preferably 12 to 20. Also preferably, the alkyl group is a linear alkyl group.

Also as mentioned above, the monomer, an alkyl (meth) acrylate having a linear alkyl group with 10 to 30 carbon atoms among the monomer (m2) corresponds to the monomer that constitutes the partial structure relating to the peak at the chemical shift 13.5 to 14.5 ppm in the component (B).

In the component (B), the content of the structural unit derived from the monomer (m2) is, from the viewpoint of improving the viscosity index and based on the total amount, 100 mol % of the structural units that constitutes the component (B), preferably 0.1 mol % or more, more preferably 1.0 mol % or more, even more preferably 2.5 mol % or more, further more preferably 5.0 mol % or more, further more preferably 6.0 mol % or more, further more preferably 7.0 mol % or more, and is preferably 50.0 mol % or less, more preferably 40.0 mol % or less, even more preferably 30.0 mol % or less, further more preferably 20.0 mol % or less, further more preferably 15.0 mol % or less.

The structural unit derived from the monomer (m2) in the component (B) can be one kind alone or two or more kinds.

The component (B) can further contain a structural unit derived from a monomer (m3) represented by the following general formula (b3).

(b3)

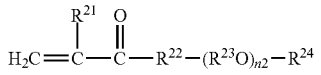

In the general formula (b3), $R^{21}$ represents a hydrogen atom or a methyl group.

$R^{22}$ represents a single bond, —O— or —NH—.

$R^{23}$ represents a linear alkylene or branched alkylene group having 2 to 4 carbon atoms. n2 represents an integer of 1 to 20. When n2 is an integer of 2 or more, plural $R^{23}$'s can be the same or different, and the $(R^{230})_{n2}$ moiety can be in random copolymerization or block copolymerization.

$R^{24}$ represents a linear alkyl group having 1 to 12 carbon atoms, or a branched alkyl group having 1 to 12 carbon atoms.

As described above, a monomer where $R^{24}$ is a linear alkyl group having 4 to 12 carbon atoms among the monomer (m3) represented by the general formula (b3) corresponds to the monomer that constitutes the partial structure relating to the peak at the chemical shift 13.5 to 14.5 ppm in the component (B).

Preferably, the component (B) further contains a structural unit derived from the monomer (m3) represented by the general formula (b3), since the viscosity index of the resultant lubricating oil composition can be more readily improved.

In the general formula (b3), $R^{21}$ is preferably a methyl group.

Also from the same viewpoint, $R^{22}$ is preferably —O—.

Specifically, the monomer (m3) preferably contains an acryloyl group or a methacryloyl group as a polymerizable functional group, and more preferably contains a methacryloyl group.

Also from the same viewpoint, n2 is preferably 1 to 5, more preferably 1 to 2, even more preferably 1.

Also from the same viewpoint, $R^{23}$ is preferably a linear alkylene group having 2 to 3 carbon atoms, more preferably an ethylene group.

Also from the same viewpoint, $R^{24}$ is preferably a linear alkyl group having 1 to 12 carbon atoms, more preferably a linear alkyl group having 2 to 8 carbon atoms, even more preferably a linear alkyl group having 2 to 6 carbon atoms, further more preferably an n-butyl group.

In the case where the component (B) contains a structural unit derived from the monomer (m3), the content of the structural unit derived from the monomer (m3) is, from the viewpoint of improving the viscosity index and based on the total amount, 100 mol % of the structural units that constitute the component (B), preferably 0.1 mol % or more, more preferably 1.0 mol % or more, even more preferably 3.0 mol % or more, further more preferably 5.0 mol % or more, and is preferably 15.0 mol % or less, more preferably 14.0 mol % or less, even more preferably 13.0 mol % or less, further more preferably 12.0 mol % or less.

The structural unit derived from the monomer (m3) contained in the component (B) can be one kind alone or two or more kinds.

Structural unit derived from any other monomers than the above-mentioned macromonomer (α), monomer (m1), monomer (m2) and monomer (m3) can be contained in the component (B) within a range not significantly detracting from the advantageous effects of the present invention.

Examples of the other monomers include one or more selected from an alkyl (meth)acrylate having a linear alkyl group with 1 to 3 carbon atoms or a branched alkyl group with 1 to 3 carbon atoms, such as methyl (meth)acrylate; styrene; and an N-alkyl(meth)acrylamide.

In that case, the total content of the structural unit derived from the macromonomer (α) and the structural units derived from the monomers (m1) to (m3) is, from the viewpoint of improving the viscosity index and based on the total amount 100 mol % of the structural units that constitute the component (B), preferably 85 to 100 mol %, more preferably 90 to 100 mol %, even more preferably 95 to 100 mol %.

The structural unit derived from the other monomer contained in the component (B) can be one kind alone or two or more kinds.

The component (B) is preferably a PMA polymer having PSSI of 30 or less. Here, PSSI means a permanent shear stability index, and indicates a capability to resist polymer decomposition. A polymer having a smaller PSSI is stabler to shear, and is more hardly decomposed. PSSI indicates viscosity reduction by polymer-derived shear as percentage, and is calculated by the following math formula defied by ASTM D6022-06(2012).

$$PSSI = \frac{Kv_0 - Kv_1}{Kv_0 - Kv_{oil}} \times 100$$

In the math formula, $Kv_0$ represents a value of 100° C. kinematic viscosity of a mixture prepared by adding a polymer to a base oil. $Kv_1$ represents a value of 100° C. kinematic viscosity of the mixture in which a polymer is added to a base oil, after having passed through 30-cycle high-shear Bosh Diesel Injector according to a process of ASTM D6278. $Kv_{oil}$ represents a value of 100° C. kinematic viscosity of a base oil. As the base oil, used is a base oil of Group II having a 100° C. kinematic viscosity of 5.35 $mm^2/s$ and a viscosity index of 105.

The PSSI is preferably 10 or less, more preferably 5.0 or less, even more preferably 3.0 or less, further more preferably 2.0 or less.

Though not specifically limited, the lower limit of the PSSI is, for example 0 or more.

The content of the component (B) can be appropriately controlled in order to make the lubricating oil composition have a desired kinematic viscosity, but is, from the viewpoint of more readily improving the viscosity index, for example, based on the total amount (100% by mass) of the lubricating oil composition, preferably 0.1% by mass or more, more preferably 0.5% by mass or more, even more preferably 1.0% by mass or more, further more preferably 2.0% by mass or more, further more preferably 2.5% by mass or more, and is preferably 30.0% by mass or less, more preferably 20.0% by mass or less, even more preferably 15.0% by mass or less, further more preferably 10.0% by mass or less, further more preferably 5.0% by mass or less.

As one embodiment of the lubricating oil composition, the content of the component (B) is, based on the total amount, 100% by mass of the lubricating oil composition, preferably 0.1 to 30.0% by mass, more preferably 0.5 to 20.0% by mass, even more preferably 1.0 to 15.0% by mass, further more preferably 2.0 to 10.0% by mass, further more preferably 2.0 to 5.0% by mass, further more preferably 2.5 to 5.0% by mass.

(Production Method for Polymer (B))

The component (B) can be produced using a known polymerization method. For example, monomers to constitute a polymer that can satisfy the above-mentioned requirements (B-1) and (B-2) are selected so as to contain the monomers to be the feedstocks for the above-mentioned structural units, and the monomers are radically polymerized to give the intended polymer.

As the polymerization method, employable are hitherto-known methods such as a solution polymerization method, an emulsion polymerization method, a suspension polymerization method, a reversed phase suspension polymerization method, a thin-film polymerization method and a spray polymerization method. Among these, preferred is a solution polymerization method, in which monomers to be the feedstocks for the above-mentioned structural units are radically polymerized in a solvent to give the intended polymer.

For example, in the case where the component (B) is produced in solution polymerization, monomers to be the feedstocks for the above-mentioned structural units ($p_{10}$) and ($p_{14}$), and optionally those for any other structural units are radically polymerized in a solvent using a polymerization initiator to give the intended polymer.

The solvent can be any solvent capable of dissolving the monomers, and includes an aromatic hydrocarbon solvent such as toluene, xylene and an alkylbenzene having 9 to 10 carbon atoms; an aliphatic hydrocarbon solvent having 5 to 18 carbon atoms such as pentane, hexane, heptane, cyclohexane and octane; an alcohol solvent having 3 to 8 carbon atoms such as 2-propanol, 1-butanol, 2-butanol and 1-octanol; an ketone solvent such as methyl isobutyl ketone, and methyl ethyl ketone; an amide solvent such as N, N-dimethylformamide, and N-methylpyrrolidone; and a base oil. Among these, a base oil is preferred, and among the base oil, the above-mentioned base oil (A) is more preferred.

The polymerization initiator includes one or more selected from the group consisting of an azo initiator, a peroxide initiator, a redox initiator, and an organic halide initiator. As the polymerization initiator for use for polymerization to give the component (B), preferred is one or more selected from an azo initiator and a peroxide initiator, more preferred is one or more selected from an azo initiator and an organic peroxide, and even more preferred is an azo initiator.

Examples of the azo initiator include 2,2'-azobis(isobutyronitrile) (abbreviation: AIBN), 2,2'-azobis(2-methylbutyronitrile) (abbreviation: AMBN), 2,2'-azobis(2,4-dimethylvaleronitrile) (abbreviation: ADVN), 4,4'-azobis(4-cyanovaleric acid) (abbreviation: ACVA) and salts thereof (for example, hydrochloride), dimethyl 2,2'-azobisisobutyrate, 2,2'-azobis(2-amidinopropane) hydrochloride, and 2,2'-azobis[2-methyl-N-(2-hydroxyethyl)propionamide].

The peroxide initiator includes an inorganic peroxide and an organic peroxide.

Examples of the inorganic peroxide include hydrogen peroxide, ammonium persulfate, potassium persulfate and sodium persulfate.

Examples of the organic peroxide include benzoyl peroxide, di-tert-butyl peroxide, cumene hydroperoxide, succinic acid peroxide, di(2-ethoxyethyl) peroxydicarbonate, tert-butyl peroxypivalate, tert-hexyl peroxypivalate, tert-butylperoxy neoheptanoate, tert-butylperoxy neodecanoate, tert-butylperoxy 2-ethylhexanoate, tert-butylperoxy isobutyrate, tert-amylperoxy 2-ethylhexanoate, 1,1,3,3-tetramethylbutylperoxy 2-ethylhexanoate, dibutylperoxy trimethyladipate, and lauryl peroxide.

The redox initiator includes a combination of a reducing agent, such as an alkali metal sulfite or bisulfite (for example, ammonium sulfite, ammonium bisulfite), ferrous chloride, ferrous sulfate or ascorbic acid, and an oxidizing agent such as an alkali metal persulfate, ammonium persulfate, hydrogen peroxide or an organic peroxide.

In the radical polymerization, as needed, a known chain transfer agent can be used for the purpose of controlling the physical properties such as the molecular weight of the polymer.

Examples of the chain transfer agent include mercaptans, thiocarboxylic acids, secondary alcohols such as isopropanol, amines such as dibutylamine, hypophosphites such as sodium hypophosphite, chlorine-containing compounds, and alkylbenzene compounds.

Examples of the mercaptans include alkylmercaptan compounds having an alkyl group with 2 to 20 carbon atoms, such as n-butylmercaptan, isobutylmercaptan, n-octylmercaptan, n-dodecylmercaptan, sec-butylmercaptan, tert-butylmercaptan, and tert-dodecylmercaptan; and hydroxy group-containing mercaptan compounds such as mercaptoethanol and mercaptopropanol.

Examples of the thiocarboxylic acids includes thioglycolic acid, and thiomalic acid.

The amount to be used of the polymerization initiator and the chain transfer agent can be appropriately selected in consideration of the desired physical properties of the polymer (e.g., molecular weight control).

The polymerization control method includes an adiabatic polymerization method and a temperature-controlled polymerization method. The reaction temperature in polymerization is preferably 30 to 140° C., more preferably 50 to 130° C., even more preferably 70° C. to 120° C.

In addition to the method of thermal polymerization initiation, also employable is a method of initiating polymerization by irradiation with radiations, electron beams or UV rays. Preferred is a temperature-controlled solution polymerization method.

For copolymerization, any of random addition polymerization or alternate polymerization is employable, and any of graft copolymerization or block copolymerization is employable.

The component (B) is favorably used as a viscosity index improver for a lubricating oil composition.

The viscosity index improver can be composed of the component (B), or the component (B) can be further dissolved in or diluted with a diluent to give a viscosity index improver composition for use herein.

As the diluent, the solvent for use in polymerization mentioned above can be used, and preferred is a base oil, more preferred is the base oil (A). One kind alone or two or more kinds of diluents mentioned above can be used either singly or as combined.

In the case where the component (B) is used for the viscosity index improver composition, the content of the component (B) in the viscosity index improver composition is, in the total amount 100% by mass of the viscosity index improver composition, preferably 5 to 80% by mass, more preferably 10 to 70% by mass, even more preferably 15 to 60% by mass.

In the viscosity index improver composition, the content of the diluent is, in the total amount 100% by mass of the viscosity index improver composition, preferably 20 to 95% by mass, more preferably 30 to 90% by mass, even more preferably 40 to 85% by mass.

The total content of the base oil (A) and the component (B) is, from the viewpoint of more readily exerting the advantageous effects of the present invention and based on the total amount, 100% by mass of the lubricating oil composition, preferably 70.0% by mass or more, more preferably 75.0% by mass or more, even more preferably 80.0% by mass or more, further more preferably 85.0% by mass or mores, and is preferably 100% by mass or less.

As one embodiment of the lubricating oil composition, the total content of the base oil (A) and the component (B) is, based on the total amount, 100% by mass of the lubricating oil composition, preferably 70.0 to 100% by mass, more preferably 75.0 to 100% by mass, even more preferably 80.0 to 100% by mass, further more preferably 85.0 to 100% by mass, and can be 100% by mass.

<Other Components>

The lubricating oil composition of one embodiment of the present invention can further contain, as needed and within a range not detracting from the advantageous effects of the present invention, any other components than the base oil (A) and the component (B).

The other components include a base oil except the base oil (A) and additives for lubricating oil except the component (B).

(Base Oil except Base Oil (A))

The base oil except the base oil (A) that can be used as the other component is not specifically limited so far as not detracting from the advantageous effects of the present invention, for which, therefore, any arbitrary ones can be appropriately selected from mineral oils and synthetic oils heretofore used as a base oil for a lubricating oil.

Examples of the mineral oil include oils produced by purification of a lubricating oil fraction obtained by reduced-pressure distillation of atmospheric residues obtained by atmospheric distillation of crude oils, by one or more, preferably all of the following treatments: solvent deasphalting treatment; at least one treatment of solvent extraction or hydrocracking; at least one dewaxing treatment of solvent dewaxing or catalytic dewaxing; hydrorefining treatment; and the like, and oils produced by isomerization of mineral waxes. Among these mineral oils, preferred are oils processed by hydrorefining.

Examples of the synthetic oil include polybutenes; poly-α-olefins such as α-olefin homopolymers, and α-olefin copolymers (e.g., ethylene-α-olefin copolymers); various esters such as polyol esters, dibasic acid esters, and phosphate esters; various ethers such as polyphenyl ethers; polyglycols; alkylbenzenes; alkylnaphthalenes; GTL base oils produced by hydroisomerization dewaxing of a bottom wax in a GTL process (gas-to-liquid wax). Among these synthetic oils, preferred are GTL base oils.

One kind alone or two or more kinds of the above-mentioned base oils can be used here.

Regarding the base oil that the lubricating oil composition contains, when a base oil is used as the solvent in polymerization to produce the polymer (B) and when the base oil used as the solvent is, as it is, added to the lubricating oil composition, it can be considered that the base oil used as the solvent can be a kind of the base oil that the lubricating oil composition contains. Similarly, when the viscosity index improver composition contains a base oil as the diluent and when the base oil used as the diluent is, as it is, added to the lubricating oil composition, the base oil used as the diluent can also be considered to be a kind of the base oil that the lubricating oil composition contains.

The content of the other base oil than the base oil (A) can be appropriately controlled within a range not detracting from the advantageous effects of the present invention. In the lubricating oil composition of one embodiment of the present invention containing any other base oil than the base oil (A), the content of the other base oil than the base oil (A) can be, for example, based on the total amount (100% by mass) of the lubricating oil composition, preferably 0.01 to 30.0% by mass, more preferably 0.1 to 25.0% by mass, even more preferably 0.5 to 20.0% by mass, further more preferably 1.0 to 15.0% by mass.

(Additives for Lubricating Oil)

The other additive for lubricating oil than the component (B) that can be used as the other component includes additives for lubricating oil that are generally used in the art, and examples of the additive for lubricating oil include one or more selected from the group consisting of a metal-based detergent, an anti-wear agent, an ash-free dispersant, a viscosity index improver, an extreme-pressure agent, a pour point depressant, an antioxidant, an anti-foaming agent, a surfactant, an anti-emulsifying agent, a friction modifier, an oiliness improver, a rust inhibitor and a metal deactivator.

A compound having plural functions as the additive for lubricating oil (for example, a compound having functions as an anti-wear agent and an extreme-pressure agent) can also be used.

One kind alone or two or more kinds of the other additives for lubricating oil than the component (B) can be used either singly or as combined.

The content of each of these additives for lubricating oil can be appropriately adjusted within a range not impairing the effect of the present invention. In the lubricating oil composition of one embodiment of the present invention that contains the other additives for lubricating oil than the component (B), the content of each of the other additives for lubricating oil than the component (B) can be, for example, based on the total amount (100% by mass) of the lubricating oil composition, preferably 0.001 to 15.0 mass %, more preferably 0.005 to 10.0 mass %, even more preferably 0.01 to 8.0 mass %.

Further, in the lubricating oil composition of one embodiment of the present invention that contains the other additives for lubricating oil than the component (B), the total content thereof can be, based on the total amount (100% by mass) of the lubricating oil composition, preferably more than 0% by mass and 30.0% by mass or less, more preferably 0.001 to 25.0% by mass, even more preferably 0.001 to 20.0% by mass, further more preferably 0.001 to 15.0% by mass.

[Metal-Based Detergent]

Examples of the metal-based detergent include an organic acid metal salt compound containing a metal atom selected from alkali metals and alkaline earth metals, and specific examples thereof include a metal salicylate, a metal phenate and a metal sulfonate containing a metal atom selected from alkali metals and alkaline earth metals.

In this description, the "alkali metal" refers to lithium, sodium, potassium, rubidium, cesium, and francium.

In addition, the "alkaline earth metal" refers to beryllium, magnesium, calcium, strontium, and barium.

From the viewpoint of improving the high-temperature detergency, the metal atom to be contained in the metal-based detergent is preferably sodium, calcium, magnesium, or barium, and more preferably calcium.

The metal salicylate is preferably a compound represented by the following general formula (1); the metal phenate is preferably a compound represented by the following general formula (2); and the metal sulfonate is preferably a compound represented by the following general formula (3).

(1)

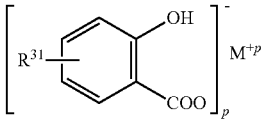

(2)

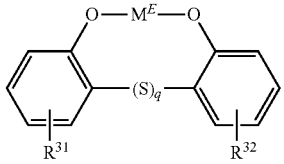

(3)

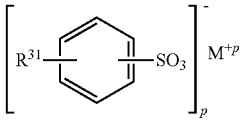

In the general formulae (1) to (3), M is a metal atom selected from alkali metals and alkaline earth metals, sodium, calcium, magnesium, or barium is preferred, and calcium is more preferred. $M^E$ is an alkaline earth metal, calcium, magnesium, or barium is preferred, and calcium is more preferred. p is the valence of M, and is 1 or 2. $R^{31}$ and $R^{32}$ each are independently a hydrogen atom or a hydrocarbon group having 1 to 18 carbon atoms. S is a sulfur atom. q is an integer of 0 or more, preferably an integer of 0 to 3.

Examples of the hydrocarbon group which may be selected as $R^{31}$ and $R^{32}$ include an alkyl group having 1 to 18 carbon atoms, an alkenyl group having 1 to 18 carbon atoms, a cycloalkyl group having 3 to 18 ring carbon atoms, an aryl group having 6 to 18 ring carbon atoms, an alkylaryl group having 7 to 18 carbon atoms, and an arylalkyl group having 7 to 18 carbon atoms.

In one embodiment of the present invention, these metal-based detergents may be used either alone or in combination of two or more thereof. Among these, from the viewpoints of an improvement in the high-temperature detergency and solubility in the base oil, the metal-based detergent is preferably one or more selected from calcium salicylate, calcium phenate, and calcium sulfonate.

In one embodiment of the present invention, the metal-based detergent may be any of a neutral salt, a basic salt, an overbased salt, and a mixture thereof.

The total base number of the metal-based detergent is preferably 0 to 600 mg KOH/g.

In one embodiment of the present invention, in the case where the metal-based detergent is a basic salt or an overbased salt, the total base number of the metal-based detergent is preferably 10 to 600 mg KOH/g, and more preferably 20 to 500 mg KOH/g.

In this description, the "base number" means a base number measured by the perchloric acid method in accordance with Item 7 of the "Petroleum Products and Lubricants-Determination of Neutralization Number" of JIS K2501:2003.

In the lubricating oil composition of one embodiment of the present invention that contains the metal-based detergent as the other component, the content of the metal-based detergent can be, based on the total amount (100% by mass) of the lubricating oil composition, preferably 0.01 to 10.0% by mass.

One kind alone or two or more kinds of the metal-based detergents can be used either singly or as combined. A preferred total content in the case of using two or more kinds is the same as the above-mentioned content.

[Anti-Wear Agent]

Examples of the anti-wear agent include sulfur-containing compounds, such as zinc dialkyl dithiophosphates (ZnDTP), zinc phosphate, disulfides, sulfurized olefins, sulfurized oils and fats, sulfurized esters, thiocarbonates, thiocarbamates, and polysulfides; phosphorus-containing compounds, such as phosphite esters, phosphate esters, phosphonate esters, and amine salts or metal salts thereof; and sulfur- and phosphorous-containing anti-wear agents, such as thiophosphite esters, thiophosphate esters, thiophosphonate esters, and amine salts or metal salts thereof.

Among these, zinc dialkyl dithiophosphates (ZnDTP) are preferred.

In the lubricating oil composition of one embodiment of the present invention that contains an anti-wear agent as the other component, the content of the anti-wear agent can be, based on the total amount (100% by mass) of the lubricating oil composition, preferably 0.05 to 5.0% by mass.

One alone or two or more kinds of the anti-wear agents can be used either singly or as combined. A preferred total content in the case of using two or more kinds is the same as the above-mentioned content.

[Ash-free Dispersant]

Examples of the ash-free dispersant include succinimide, benzylamine, succinate esters or boron modified products thereof, and alkenylsuccinimides and boron-modified alkenylsuccinimides are preferred.

The alkenylsuccinimide includes alkenylsuccinmonoimides represented by the following general formula (i) and alkenylsuccinbisimides represented by the following general formula (ii).

The alkenylsuccinimides can be modified alkenylsuccinimides produced by reacting the compound represented by the following general formula (i) or (ii) with one or more selected from alcohols, aldehydes, ketones, alkylphenols, cyclic carbonates, epoxy compounds and organic acids.

The boron-modified alkenylsuccinimide includes boron-modified products of the compound represented by the following general formula (i) or (ii).

(i)

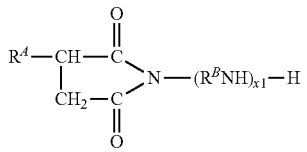

(ii)

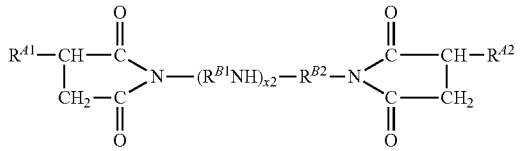

In the general formulae (i) and (ii), $R^A$, $R^{A1}$ and $R^{A2}$ each are independently an alkenyl group having a mass average molecular weight (Mw) of 500 to 3,000 (preferably 1,000 to 3,000), and are preferably a polybutenyl group or a polyisobutenyl group.

$R^B$, $R^{B1}$ and $R^{B2}$ each are independently an alkylene group having 2 to 5 carbon atoms.

x1 is an integer of 1 to 10, preferably an integer of 2 to 5, more preferably 3 or 4.

x2 is an integer of 0 to 10, preferably an integer of 1 to 4, more preferably 2 or 3.

The ratio of the boron atom to the nitrogen atom [B/N] constituting the boron modified alkenylsuccinimide is, from the viewpoint of improving detergency, preferably 0.5 or more, more preferably 0.6 or more, even more preferably 0.8 or more, further more preferably 0.9 or more.

In the lubricating oil composition of one embodiment of the present invention containing an ash free dispersant as the other component, the content of the ash free dispersant is, based on the total amount (100% by mass) of the lubricating oil composition, preferably 0.1 to 20.0% by mass.

[Viscosity Index Improver]

The viscosity index improver is a polymer except the above mentioned component (B), and examples thereof include PMA compounds such as non-dispersant-type polyalkyl (meth)acrylates and dispersant-type polyalkyl (meth) acrylates; OCP compounds such as olefin copolymers (e.g., ethylene-propylene copolymers), and dispersant-type olefin copolymers; and styrene copolymers (e.g., styrene-diene copolymers, and styrene-isoprene copolymers). (Hereinafter these may also be referred to as "other viscosity index improvers".)

These other viscosity index improvers preferably have a mass-average molecular weight (Mw) of 5,000 or more and 1,500,000 or less. Of these, PMA compounds have Mw of preferably 20,000 or more, more preferably 100,000 or more, and preferably 1,000,000 or less, more preferably 800,000 or less. OCP compounds have Mw of preferably 10,000 or more, more preferably 20,000 or more, and preferably 800,000 or less, more preferably 500,000 or less.

The mass-average molecular weight (Mw) can be measured, for example, according to the method described in Examples to be given hereinafter.

Also the other viscosity index improver is preferably a polyalkyl (meth)acrylate having PSSI of 30 or less.

The monomer constituting the polyalkyl (meth)acrylate is an alkyl (meth)acrylate, preferably an alkyl (meth)acrylate having a linear alkyl group with 1 or more and 18 or less carbon atoms, or a branched alkyl group with 3 or more and 34 or less carbon atoms.

The polystyrene-equivalent mass-average molecular weight (Mw) of the polyalkyl (meth)acrylate is preferably 10,000 or more and 1,000,000 or less, more preferably 30,000 or more and 500,000 or less. When the mass-average molecular weight of the polyalkyl (meth)acrylate falls within the range, the value of PSSI thereof can be readily controlled to be 30 or less.

The mass-average molecular weight (Mw) can be measured, for example, according to the method described in Examples to be given hereinafter.

One kind alone or two or more kinds of these other viscosity index improver can be used either singly or as combined.

The other viscosity index improver is, for example, as a resin component, the above-mentioned polymers than the component (B), and as mentioned above, in consideration of handleability and solubility in a base oil, many of these are commercially available in the form of a viscosity index improver composition where the polymer-containing resin component is diluted with a diluent oil such as a base oil.

In this case, when such other viscosity index improver is used, the content of the viscosity index improver is, in terms of the content of the resin component therein and based on the total amount (100% by mass) of the lubricating oil composition, preferably 0.001% by mass or more, more preferably 0.05% by mass or more, even more preferably 0.5% by mass or more, and is preferably 10.0% by mass or less, more preferably 5.0% by mass or less, even more preferably 2.5% by mass or less.

[Extreme-Pressure Agent]

Examples of the extreme-pressure agent include a sulfur-based extreme-pressure agent such as sulfides, sulfoxides, sulfones, and thiophosphinates, a halogen-based extreme-pressure agent such as chlorinated hydrocarbons, and an organic metal-based extreme-pressure agent. Further, among the above-described anti-wear agents, a compound having a function as an extreme-pressure agent can also be used.

One kind alone or two or more kinds of these extreme-pressure agents can be used either singly or as combined.

In the lubricating oil composition of one embodiment of the present invention containing an extreme-pressure agent as the other component, the content of the extreme-pressure agent is, based on the total amount (100% by mass) of the lubricating oil composition, preferably 0.1 to 10.0% by mass.

[Antioxidant]

As the antioxidant, any publicly-known antioxidant can be appropriately selected and used among publicly-known antioxidants used in the related art as an antioxidant for lubricating oil, and examples thereof include an amine-based antioxidant, a phenol-based antioxidant, a molybdenum-based antioxidant, a sulfur-based antioxidant, and a phosphorus-based antioxidant.

Examples of the amine-based antioxidant include a diphenylamine-based antioxidant, such as diphenylamine and an alkylated diphenylamine having an alkyl group having 3 to 20 carbon atoms; and a naphthylamine-based antioxidant, such as α-naphthylamine, phenyl-α-naphthylamine, and a substituted phenyl-α-naphthylamine having an alkyl group having 3 to 20 carbon atoms.

Examples of the phenol-based antioxidant include a monophenol-based antioxidant, such as 2,6-di-tert-butylphenol, 2,6-di-tert-butyl-4-methylphenol, 2,6-di-tert-butyl-4-ethylphenol, isooctyl-3-(3,5-di-tert-butyl-4- and octadecyl-3-(3,5-di-tert-butyl-4-hydroxyphenyl)propionate, hydroxyphenyl)propionate; a diphenol-based antioxidant, such as 4,4'-methylenebis(2,6-di-tert-butylphenol) and 2,2'-methylenebis(4-ethyl-6-tert-butylphenol); and a hindered phenol-based antioxidant.

Examples of the molybdenum-based antioxidant include a molybdenum amine complex obtained by allowing molybdenum trioxide and/or molybdic acid to react with an amine compound.

Examples of the sulfur-based antioxidant include dilauryl-3,3'-thiodipropionate.

Examples of the phosphorus-based antioxidant include phosphites. In the case of using a phosphorus-based antioxidant, preferably, the content thereof is to satisfy the preferred phosphorus atom content in the lubricating oil composition mentioned below.

One kind alone or two or more kinds of these antioxidants can be used either singly or arbitrarily combined, and preferred is a phenol-based antioxidant and/or an amine-based antioxidant.

In the lubricating oil composition of one embodiment of the present invention containing an antioxidant as the other component, the content of the antioxidant is, based on the total amount (100% by mass) of the lubricating oil composition, preferably 0.05 to 7.0% by mass.

[Pour Point Depressant]

Examples of the pour-point depressant include an ethylene-vinyl acetate copolymer, a condensate of a chlorinated paraffin and naphthalene, a condensate of a chlorinated paraffin and phenol, a polymethacrylate compound (e.g., PMA compound; polyalkyl (meth)acrylate), a polyvinyl acetate, a polybutene and a polyalkylstyrene, and a polymethacrylate compound is preferred. One alone or two or more kinds of these pour point depressants can be used either singly or as combined.

In the lubricating oil composition of one embodiment of the present invention containing a pour point depressant as the other component, the content of the pour point depressant is, based on the total amount (100% by mass) of the lubricating oil composition, preferably 0.01 to 10.0% by mass.

[Anti-Foaming Agent]

Examples of the anti-foaming agent include silicone oil such as dimethylpolysiloxane, as well as fluorosilicone oil, and fluoroalkyl ether. One kind alone or two or more kinds of these anti-foaming agents can be used either singly or as combined.

In the lubricating oil composition of one embodiment of the present invention containing an anti-foaming agent as the other component, the content of the anti-foaming agent is, based on the total amount (100% by mass) of the lubricating oil composition, preferably 0.05 to 5.0% by mass.

[Surfactant or Anti-Emulsifying Agent]

The surfactant or anti-emulsifying agent includes a polyalkylene glycol-based nonionic surfactant such as a polyoxyethylene alkyl ether, a polyoxyethylene alkylphenyl ether, and a polyoxyethylene alkylnaphthyl ether. One kind alone or two or more kinds of these surfactants and anti-emulsifying agents can be used either singly or as combined in any arbitrary manner.

In the lubricating oil composition of one embodiment of the present invention containing a surfactant or an anti-emulsifying agent as the other component, the content of the surfactant or the anti-emulsifying agent is, each independently based on the total amount (100% by mass) of the lubricating oil composition, preferably 0.01 to 3.0% by mass.

[Friction Modifier]

Examples of the friction modifier include a molybdenum-based friction modifier, such as molybdenum dithiocarbamate (MoDTC), molybdenum dithiophosphate (MoDTP), and an amine salt of molybdic acid; an ash-free friction modifier having at least one alkyl group or alkenyl group having 6 to 30 carbon atoms, such as an aliphatic amine, a fatty acid ester, a fatty acid amide, a fatty acid, an aliphatic alcohol, and an aliphatic ether; oils and fats, amines, amides, sulfurized esters, phosphate esters, phosphite esters, and phosphate ester amine salts.

In the lubricating oil composition of one embodiment of the present invention containing a friction modifier as the other component, the content of the friction modifier is, based on the total amount (100% by mass) of the lubricating oil composition, preferably 0.05 to 4.0% by mass.

[Oiliness Improver]

The oiliness improver includes an aliphatic saturated or unsaturated monocarboxylic acid such as stearic acid and oleic acid; a polymer fatty acid such as a dimer acid and a hydrogenated dimer acid; a hydroxy-fatty acid such as ricinoleic acid, and 12-hydroxystearic acid; an aliphatic saturated or unsaturated monoalcohol such as lauryl alcohol and oleyl alcohol; an aliphatic saturated or unsaturated monoamine such as stearyl amine and oleyl amine; an aliphatic saturated or unsaturated monocarboxylic acid amide such as lauric acid amide and oleic acid amide; and a partial ester of a polyalcohol, such as glycerin or sorbitol, and an aliphatic saturated or unsaturated monocarboxylic acid.

In the lubricating oil composition of one embodiment of the present invention containing the oiliness improver as the other component, the content of the oiliness improver is, based on the total amount (100% by mass) of the lubricating oil composition, preferably 0.01 to 5.0% by mass.

[Rust Inhibitor]

Examples of the rust inhibitor include fatty acids, alkenyl succinic half esters, fatty acid soaps, alkyl sulfonate salts, polyhydric alcohol fatty acid esters, fatty acid amines, oxidized paraffins, and alkyl polyoxyethylene ethers.

In the lubricating oil composition of one embodiment of the present invention containing a rust inhibitor as the other component, the content of the rust inhibitor is, based on the total amount (100% by mass) of the lubricating oil composition, preferably 0.01 to 3.0% by mass.

[Metal Deactivator]

Examples of the metal deactivator include a benzotriazole-based compound, a tolyltriazole-based compound, a thiadiazole-based compound, an imidazole-based compound, and a pyrimidine-based compound.

In the lubricating oil composition of one embodiment of the present invention containing a metal deactivator as the other component, the content of the metal deactivator is, based on the total amount (100% by mass) of the lubricating oil composition, preferably 0.01 to 5.0% by mass.

<Properties of Lubricating Oil Composition>

The 100° C. kinematic viscosity of the lubricating oil composition is preferably 1.0 to 15.0 $mm^2/s$, more preferably 4.0 to 15.0 $mm^2/s$, even more preferably 5.0 to 12.0 $mm^2/s$, further more preferably 6.0 to 10.0 $mm^2/s$.

The 40° C. kinematic viscosity of the lubricating oil composition is preferably 10.0 to 40.0 $mm^2/s$, more preferably 15.0 to 30.0 $mm^2/s$, even more preferably 20.0 to 25.0 $mm^2/s$.

The viscosity index of the lubricating oil composition is preferably 300 or more, more preferably 305 or more, even more preferably 310 or more, further more preferably 315 or more.

Each of the kinematic viscosity and the viscosity index are values measured according to the method described in Examples given hereinafter.

[Production Method for Lubricating Oil Composition]

A production method for the lubricating oil composition of one embodiment of the present invention includes blending a viscosity index improver (B) satisfying the following requirements (B-1) and (B-2) in a base oil (A) satisfying the following requirements (A-1) to (A-4):

- Requirement (A-1): 100° C. kinematic viscosity is 2.0 $mm^2/s$ or more and less than 7.0 $mm^2/s$.
- Requirement (A-2): Viscosity index is 100 or more.
- Requirement (A-3): Cycloparaffin content, as measured according to ASTM D 2786-91(2016), is 35.0% by volume or less based on the total amount, 100% by volume of the base oil (A).
- Requirement (A-4): % CA is less than 1.0.
- Requirement (B-1): Ratio of the mass-average molecular weight (Mw) to the number-average molecular weight (Mn), [Mw/Mn] is 1.0 or more and less than 6.0.
- Requirement (B-2): Ratio of the peak integral value ($I_{10}$) at a chemical shift 10.0 to 11.0 ppm to the peak integral value ($I_{14}$) at a chemical shift 13.5 to 14.5 ppm, as determined in C13-NMR analysis, [$I_{10}/I_{14}$] is 0.05 or more.

In the production method, as needed, any other component than the component (B) may be further blended in the base oil (A).

The base oil (A), the component (B) and the other component are the same as those described for the lubricating oil composition, and preferred embodiments thereof are also the same, and the lubricating oil composition obtained in the production method are the same as mentioned above, and accordingly, these descriptions are omitted here.

In the production method, the base oil (A), the component (B) and the other component added as needed can be mixed in any method, and the method is not limited.

[Use of Lubricating Oil Composition]

As mentioned above, the lubricating oil composition of one embodiment of the present invention has a high viscosity index.

Consequently, the lubricating oil composition of one embodiment of the present invention can be favorably used in various applications, for example, for driving system oils such as gear oils (e.g., manual transmission oils, differential oils), automatic transmission oils and the like, continuously variable transmission oils (e.g., belt CVT oils, toroidal CVT oils), power steering oils, shock absorber oils, and electric motor oils; internal combustion engine (engine) oils for gasoline engines, diesel engines, gas engines, and the like hydraulic oils; turbine oils; compressor oils; fluid dynamic bearing oils; and rolling bearing oils. Filled in the devices used for these applications, the lubricating oil composition is favorably used as a lubricating oil for lubricating the parts constituting the devices.

Among these, the lubricating oil composition of one embodiment of the present invention has a characteristic feature of a high viscosity index, and is therefore more favorably used as a lubricating oil composition usable in a broader temperature range, for example, as a lubricating oil for drive system devices such as gears, automatic transmissions, continuously variable transmissions, shock absorbers, power steering and electric motors that are mounted on transport machinery such as motorcars, e.g., motorcycles and four-wheeled vehicles, railway trains, ships and airplanes, and generators and various machine tools; and a lubricating oil for internal combustion engines such as gasoline engines, diesel engines and gas engines.

[Lubrication Method Using Lubricating Oil Composition]

As described in the above, a lubrication method that uses the lubricating oil composition of one embodiment of the present invention is preferably a method of lubricating various parts of various devices mentioned above, by filling the lubricating oil composition in the devices for use for the above-mentioned applications.

The lubrication method using the lubricating oil composition of one embodiment of the present invention is more preferably a lubrication method of filling the lubricating oil composition in, for example, drive system devices such as gears, automatic transmissions, continuously variable transmissions, shock absorbers, power steering and electric motors that are mounted on transport machinery such as motorcars, e.g., motorcycles and four-wheeled vehicles, railway trains, ships and airplanes, and generators and various machine tools; and internal combustion engines such as gasoline engines, diesel engines and gas engines, to thereby lubricate the parts of the drive system devices and the parts of the internal combustion engines.

[Drive System Device Using Lubricating Oil Composition]

Another embodiment of the present invention is a drive system device using the lubricating oil composition of one embodiment of the present invention mentioned above, preferably a drive system device using the lubricating oil composition as a drive system oil. Examples of the drive system device include gears, automatic transmissions, continuously variable transmissions, shock absorbers, power steering and electric motors that are mounted on transport machinery such as motorcars, e.g., motorcycles and four-wheeled vehicles, railway trains, ships and airplanes, and generators and various machine tools.

[Internal Combustion Engine Using Lubricating Oil Composition]

Another embodiment of the present invention is an internal combustion engine using the lubricating oil composition of one embodiment of the present invention mentioned above, and is preferably an internal combustion engine (an engine) using the lubricating oil composition as an engine oil. Examples of the internal combustion engine include gasoline engines, diesel engines and gas engines that are mounted on transport machinery such as motorcars, e.g., motorcycles and four-wheeled vehicles, railway trains, ships and airplanes.

EXAMPLES

The present invention is hereunder described in more detail by reference to Examples, but it should be construed that the present invention is by no means limited by the following Examples.

In this description, physical properties of the feedstock materials used in Examples and Comparative Examples and those of the lubricating oil compositions of Examples and Comparative Examples were determined according to the following processes.

<Kinematic Viscosity (40° C. Kinematic Viscosity, 100° C. Kinematic Viscosity)>

Values measured using a glass capillary viscometer, according to JIS K2283:2000.

<Viscosity Index>

Values calculated according to JIS K2283:2000.

<Ring Analysis (% CA)>

The aromatic content (% CA) indicates a proportion (percentage) of the aromatic content calculated in a ring analysis n-d-M method according to ASTM D-3238.

<Type Analysis of Paraffin Content in Base Oil, and Content of Each Paraffin Component in Base Oil>

According to ASTM D2786-91(2016), the content (vol %) of cycloparaffin relative to the total amount, 100% by volume of the base oil was determined. In addition, each content (vol %) of the acyclic paraffin content (R0) and the monocyclic to hexa-cyclic cycloparaffin content ((R1) to (R6)) in the base oil was determined.

Further, the content ratio of the monocyclic cycloparaffin content ($R^1$) to the total of the dicyclic to hexa-cyclic cycloparaffin content (R2-6), [(R1)/(R2-6)] (by volume) was calculated.

<Mass-Average Molecular Weight (Mw), Number-Average Molecular Weight (Mn) and Mw/Mn of Component (B)>

The mass-average molecular weight (Mw), the number-average molecular weight (Mn) and Mw/Mn of the component (B) were determined through gel permeation chromatography (GPC) according to the following measurement method.

One column "TSKgel (registered trademark) guardcolumn Super HZ-L" and two columns "TSKgel SuperMultipore (registered trademark) HZ-M", both by Tosoh Corporation, were attached in that order from the upstream side to "1515 Isocratic HPLC Pump" and "2414 Differential Refractometer (RI) Detector" by Waters Corporation. Under the conditions of a measurement temperature 40° C., a mobile phase tetrahydrofuran, a flow rate 0.35 mL/min, and a sample concentration 1.0 mg/mL, Mw, Mn and Mw/Mn of the component (B) were determined by standard polystyrene-equivalent measurement.

<Method for Confirmation of Ratio [$I_{10/114}$] of Component (B)>

($^{13}$C-NMR Analysis)

The ratio of the peak integral value ($I_{10}$) at a chemical shift 10.0 to 11.0 ppm to the peak integral value ($I_{14}$) at a chemical shift 13.5 to 14.5 ppm, as determined in $^{13}$C-NMR analysis, [$I_{10}/I_{14}$] was confirmed according to the following method.

The ratio was confirmed from the chemical shift in $^{13}$C-NMR determined using a nuclear magnetic resonance (NMR) apparatus ("ECX-400P" by JEOL Ltd.) and the peak integral value at the corresponding chemical shift. The measurement conditions are shown below.

Solvent: heavy chloroform
Standard Substance: tetramethylsilane (TMS)
Resonant Frequency: 100 MHz
Measurement Mode: gated decoupling method
Integration Frequencies: 2,000 to 5,000 times
Pulse Delay time: 25 s
Pulse Duration: 9.25 μs
X-angle: 90°

Examples 1 to 5, Comparative Examples 1 to 8

A polymer was blended in a base oil so that the resultant lubricating oil composition could have the formulation shown in the following Table 3 (Examples 1 to 5, and Comparative Examples 1 to 5), and the following Table 4 (Examples 1 and 4, and Comparative Examples 6 to 8), and after preparation of the lubricating oil composition, the lubricating oil composition of Examples and Comparative Examples was evaluated according to the above-mentioned evaluation methods. The results are shown in the following Tables 3 and 4.

For the lubricating oil composition of Examples and Comparative Examples, the formulation of the constitutive components was controlled so that the resultant composition could have a 100° C. kinematic viscosity of about 7.5 $mm^2/s$. This is because the lubricating oil composition was prepared to have a specific kinematic viscosity at a temperature at which the lubricating oil composition would be used, and accordingly, the lubricating oil composition is to be prepared so as to have the formulation specifically controlled under the condition, and the characteristics of the thus-prepared specific lubricating oil composition need to be compared with each other. Consequently, the comparison is not a comparison made relative to the unified content of the polymer blended in the base oil but a comparison made by unifying the 100° C. kinematic viscosity of the resultant lubricating oil composition.

Compounds of the components used in Examples and Comparative Examples are shown below.

<Base Oil (A)>

Base oil 1: "YUBASE (registered trademark) Ultra-S 4" by SK Lubricants Co., Ltd.

<Base Oil Other than Base Oil (A)>

Base oil 2: mineral oil obtained by a process of hydroisomerization dewaxing of a feedstock oil containing a slack wax and a bottom oil obtained by hydrocracking a heavy fuel oil (slack wax/bottom oil=30/70, by mass), followed by hydrofinishing and thereafter reduced-pressure distillation to collect a fraction having a kinematic viscosity at 100° C. as in the following Table 1.

Details of the properties of the base oil 1 and 2 are shown in the following Table 1.

TABLE 1

| | | Unit | Base Oil 1 | Base Oil 2 |
|---|---|---|---|---|
| 100° C. Kinematic Viscosity (Requirement A-1) | | $mm^2/s$ | 4.225 | 4.517 |
| Viscosity Index (Requirement A-2) | | — | 124 | 134 |
| Cycloparaffin Content (Requirement A-3) | | vol % | 31.5 | 41.2 |
| % $C_A$ (Requirement A-4) | | — | 0 | 0 |
| Content of Each Paraffin Component | Acyclic Paraffin Component (R0) | vol % | 68.5 | 58.8 |
| | 1-ring Cycloparaffin Component (R1) | vol % | 11.7 | 15.4 |
| | 2-ring Cycloparaffin Component (R2) | vol % | 8.4 | 10.7 |
| | 3-ring Cycloparaffin Component (R3) | vol % | 3.2 | 4.8 |
| | 4-ring Cycloparaffin Component (R4) | vol % | 1.2 | 1.8 |
| | 5-ring Cycloparaffin Component (R5) | vol % | 3.6 | 4.7 |
| | 6-ring Cycloparaffin Component (R6) | vol % | 3.4 | 3.8 |
| | Total | vol % | 100.0 | 100.0 |
| | 2 to 6-ring Cycloparaffin Component (R2-6) | vol % | 19.8 | 25.8 |
| | (R1)/(R2-6) (by volume) | — | 0.6 | 0.6 |

<Polymer (B) and Other Polymer than Polymer (B)>

Formulations and properties of polymers B1 to B5 of the polymer (B), and other polymers E1 to E5 than the polymer (B) are shown in the following Table 2.

In the following Table 2, for example, "C12-18 linear alkyl methacrylate" indicates a mixture of alkyl methacrylates each having a linear alkyl group with 12 or more and 18 or less carbon atoms in the side chain. The same shall apply to "C12 to 14 linear alkyl methacrylate", "C16 to 18 linear alkyl methacrylate" and "C12 to 24 linear alkyl methacrylate". For example, "C12 to 18 linear alkyl methacrylate" includes an alkyl methacrylate having a linear alkyl group with 12 or more and 14 or less carbon atoms in the side chain, that overlaps with "C12 to 14 linear alkyl methacrylate", but in the case of including "C12 to 18 linear alkyl methacrylate" that includes, in addition to these, an alkyl methacrylate having a linear alkyl group with 15 or more and 18 or less carbon atoms in the side chain, it is described as the content of "C12 to 18 linear alkyl methacrylate" in the following Table 2, and the content of "C12 to 14 linear alkyl methacrylate" is expressed as 0 mol %.

TABLE 2

| | Polymer | B1 | B2 | B3 | B4 | B5 |
|---|---|---|---|---|---|---|
| Monomer Composition (mol %)*1 | methyl methacrylate | 0.0 | 0.0 | 0.0 | 0.0 | 0.0 |
| | n-butyl methacrylate*2 | 74.0 | 85.0 | 89.0 | 91.0 | 85.0 |
| | C12-18 linear alkyl methacrylate*2 | 14.0 | 0.0 | 0.0 | 0.0 | 0.0 |
| | C12-14 linear alkyl methacrylate*2 | 0.0 | 9.0 | 10.0 | 8.0 | 14.0 |
| | C16-18 linear alkyl methacrylate*2 | 0.0 | 0.0 | 0.0 | 0.0 | 0.0 |
| | C12-24 linear alkyl methacrylate*2 | 0.0 | 0.0 | 0.0 | 0.0 | 0.0 |
| | n-butoxyethyl methacrylate*2 | 11.0 | 0.0 | 0.0 | 0.0 | 0.0 |
| | C24 branched alkyl methacrylate | 0.0 | 0.0 | 0.0 | 0.0 | 0.0 |
| | styrene | 0.0 | 5.0 | 0.0 | 0.0 | 0.0 |
| | macromonomer*3,4 | 1.0 | 1.0 | 1.0 | 1.0 | 1.0 |
| | Mw | 600,000 | 320,000 | 300,000 | 370,000 | 430,000 |
| Mw/Mn (Requirement B-1) | | 2.4 | 2.0 | 1.8 | 5.2 | 5.5 |
| $[I_{10}/I_{14}]$ (Requirement B-2) | | 0.12 | 0.12 | 0.40 | 0.50 | 0.44 |

| | Polymer | E1 | E2 | E3 | E4 | E5 |
|---|---|---|---|---|---|---|
| Monomer Composition (mol %)*1 | methyl methacrylate | 37.0 | 41.0 | 64.0 | 48.0 | 67.0 |
| | n-butyl methacrylate*2 | 0.0 | 0.0 | 0.0 | 0.0 | 0.0 |
| | C12-18 linear alkyl methacrylate*2 | 0.0 | 0.0 | 0.0 | 52.0 | 22.0 |
| | C12-14 linear alkyl methacrylate*2 | 0.0 | 0.0 | 0.0 | 0.0 | 0.0 |
| | C16-18 linear alkyl methacrylate*2 | 0.0 | 0.0 | 20.0 | 0.0 | 0.0 |
| | C12-24 linear alkyl methacrylate*2 | 63.0 | 59.0 | 0.0 | 0.0 | 0.0 |
| | n-butoxyethyl methacrylate*2 | 0.0 | 0.0 | 0.0 | 0.0 | 0.0 |
| | C24 branched alkyl methacrylate | 0.0 | 0.0 | 16.0 | 0.0 | 11.0 |

TABLE 2-continued

| | | | | | |
|---|---|---|---|---|---|
| styrene | 0.0 | 0.0 | 0.0 | 0.0 | 0.0 |
| macromonomer*3,4 | 0.0 | 0.0 | 0.0 | 0.0 | 0.0 |
| Mw | 540,000 | 230,000 | 440,000 | 400,000 | 510,000 |
| Mw/Mn (Requirement B-1) | 2.9 | 2.1 | 3.1 | 1.7 | 2.0 |
| $[I_{10}/I_{14}]$ (Requirement B-2) | 0.0 | 0.0 | 0.0 | 0.0 | 0.0 |

*1Corresponding to content of each monomer-derived structural unit in all structural units in polymer

*2Feedstock monomer for structural unit relating to "$I_{14}$" (integral value at chemical shift 13.5 to 14.5 ppm in $^{13}$C-NMR analysis)

*3Feedstock monomer for structural unit relating to "$I_{10}$" (integral value at chemical shift 10.0 to 11.0 ppm in $^{13}$C-NMR analysis)

*4Macromonomer with Mn = 5000 to 6000 (content of isobutylene and/or 1,2-butylene in all structural units in side chain part of macromonomer is 65 mol %)

TABLE 3

| | | | unit | Example 1 | Example 2 | Example 3 | Example 4 | Example 5 |
|---|---|---|---|---|---|---|---|---|
| Formulation of Lubricating Oil Composition | Base Oil (A) | Base Oil 1 | mass % | 96.95 | 95.94 | 96.08 | 96.84 | 97.72 |
| | Polymer (B) | B1 | mass % | 3.05 | — | — | — | — |
| | | B2 | mass % | — | 4.06 | — | — | — |
| | | B3 | mass % | — | — | 3.92 | — | — |
| | | B4 | mass % | — | — | — | 3.16 | — |
| | | B5 | mass % | — | — | — | — | 2.28 |
| | Polymer other than Polymer (B) | E1 | mass % | — | — | — | — | — |
| | | E2 | mass % | — | — | — | — | — |
| | | E3 | mass % | — | — | — | — | — |
| | | E4 | mass % | — | — | — | — | — |
| | | E5 | mass % | — | — | — | — | — |
| Properties of Lubricating Oil Composition | 40° C. Kinematic Viscosity | | $mm^2/s$ | 23.53 | 24.09 | 23.57 | 23.97 | 24.20 |
| | 100° C. Kinematic Viscosity | | $mm^2/s$ | 7.480 | 7.491 | 7.555 | 7.496 | 7.475 |
| | Viscosity Index | | — | 320 | 311 | 324 | 314 | 308 |

| | | | Comparative Example 1 | Comparative Example 2 | Comparative Example 3 | Comparative Example 4 | Comparative Example 5 |
|---|---|---|---|---|---|---|---|
| Formulation of Lubricating Oil Composition | Base Oil (A) | Base Oil 1 | 98.11 | 97.05 | 97.33 | 97.79 | 97.60 |
| | Polymer (B) | B1 | — | — | — | — | — |
| | | B2 | — | — | — | — | — |
| | | B3 | — | — | — | — | — |
| | | B4 | — | — | — | — | — |
| | | B5 | — | — | — | — | — |
| | Polymer other than Polymer (B) | E1 | 1.89 | — | — | — | — |
| | | E2 | — | 2.95 | — | — | — |
| | | E3 | — | — | 2.67 | — | — |
| | | E4 | — | — | — | 2.21 | — |
| | | E5 | — | — | — | — | 2.40 |
| Properties of Lubricating Oil Composition | 40° C. Kinematic Viscosity | | 27.80 | 28.71 | 27.44 | 27.20 | 27.22 |
| | 100° C. Kinematic Viscosity | | 7.503 | 7.507 | 7.477 | 7.488 | 7.487 |
| | Viscosity Index | | 259 | 248 | 262 | 266 | 265 |

TABLE 4

| | | unit | Example 1 | Comparative Example 6 | Example 4 | Comparative Example 7 | Comparative Example 8 |
|---|---|---|---|---|---|---|---|
| Formulation of Lubricating Oil Composition | Base Oil 1 (Base Oil (A)) | mass % | 96.95 | — | 96.84 | — | — |
| | Base Oil 2 | mass % | — | 96.92 | — | 96.81 | 98.23 |
| | B1 (Polymer (B)) | mass % | 3.05 | 3.08 | — | — | — |
| | B4 (Polymer (B)) | mass % | — | — | 3.16 | 3.19 | — |
| | E1 (Polymer) | mass % | — | — | — | — | 1.77 |
| Properties of Lubricating Oil Composition | 40° C. Kinematic Viscosity | $mm^2/s$ | 23.53 | 24.90 | 23.97 | 25.30 | 28.23 |
| | 100° C. Kinematic Viscosity | $mm^2/s$ | 7.480 | 7.478 | 7.496 | 7.514 | 7.523 |
| | Viscosity Index | — | 320 | 297 | 314 | 294 | 255 |

As shown in Table 3, the lubricating oil compositions of Examples 1 to 5 contain the base oil 1 as the base oil (A) and the polymer (B) satisfying the requirements (B-1) and (B-2), and therefore it is confirmed that the viscosity index thereof is increased more than the lubricating oil compositions of Comparative Examples 1 to 5 that contain the same base oil 1 but contain a polymer not satisfying the requirements of the polymer (B), especially the requirement (B-2) thereof.

Also as shown in Table 4, the lubricating oil compositions of Examples 1 and 4 contain the base oil 1 as the base oil (A) and the polymer (B) satisfying the requirements (B-1) and (B-2), and therefore it is confirmed that the viscosity index thereof is increased more than the lubricating oil compositions of Comparative Examples 6 and 7 that contain the same polymer (B) but contain the base oil 2 not satisfying the requirements of the base oil (A), especially the requirement (A-3) thereof.

The lubricating oil composition of Comparative Example 8 contains the base oil 2 not satisfying the requirements of the base oil (A) and the polymer E1 not satisfying the requirements of the polymer (B), and therefore it is confirmed that the viscosity index thereof is extremely low as compared with the lubricating oil compositions of Examples.

INDUSTRIAL APPLICABILITY

The lubricating oil composition of one embodiment of the present invention has a higher viscosity index than conventional lubricating oil compositions.

Consequently, the lubricating oil composition of one embodiment of the present invention can be favorably used as a lubricating oil composition for use in a broad temperature range, for example, as mentioned above, like a drive system oil or an internal combustion engine lubricating oil.

The invention claimed is:

1. A lubricating oil composition, comprising:

(A) a base oil having (A-1) a 100° C. kinematic viscosity is in a range of from 2.0 to less than 7.0 $mm^2/s$;

(A-2) a viscosity index is 100 or more;

(A-3) a cycloparaffin content, measured according to ASTM D 2786-91 (2016), of 35.0 vol. % or less, based on a total base oil (A) volume; and (A-4) an aromatic content (% CA) is less than 1.0; and (B) a polyalkyl(meth)acrylate polymer comprising, each in polymerized form; an alkyl(meth)acrylate; a macromonomer (α) comprising a (meth)acryloyl end group; and butadiene or hydrogenated butadiene, the polyalkyl(meth) acrylate polymer (B) having:

(B-1) an Mw/Mn ratio of a mass-average molecular weight (Mw) to a number-average molecular weight (Mn), in a range of from 1.0 to less than 6.0; and (B-2) an $I_{10}/I_{14}$ ratio of a peak integral value ($I_{10}$) at a chemical shift 10.0 to 11.0 ppm to a peak integral value ($I_{14}$) at a chemical shift 13.5 to 14.5 ppm, as determined in $^{13}$C-NMR analysis, is 0.05 or more.

2. The composition of claim 1, comprising the base oil (A) in a range of from 50.0 to 99.9 wt. %, based on a total lubricating oil composition mass.

3. The composition of claim 1, wherein the base oil (A) is a base oil grouped in API Group II or Group III.

4. The composition of claim 1, wherein the base oil (A) further has (A-5) an (R1)/(R2-6) content ratio of a monocyclic cycloparaffin content (R1) to a total of a dicyclic to hexa-cyclic cycloparaffins content (R2-6), measured according to ASTM D 2786-91 (2016), of 1.0 or less by volume.

5. The composition of claim 1, wherein the base oil (A) further has (A-6) a content of a tricyclic cycloparaffin (R3), as measured according to ASTM D 2786-91 (2016), less than 4.0% by volume, based on the total base oil (A) volume.

6. The composition of claim 1, wherein the $I_{10}/I_{14}$ ratio of the polyalkyl(meth)acrylate polymer (B) is in a range of from 0.05 to 5.00.

7. The composition of claim 1, comprising the polyalkyl (meth)acrylate polymer (B) in a range of from 0.1 to 30.0 wt. %, based on a total lubricating oil composition mass.

8. The composition of claim 1, wherein a total content of the base oil (A) and the polyalkyl(meth)acrylate polymer (B) is in a range of from 70.0 to 100 wt. %, based on a total lubricating oil composition mass.

9. The composition of claim 1, having a 100° C. kinematic viscosity in a range of from 1.0 to 15.0 $mm^2/s$.

10. The composition of claim 1, having a viscosity index is 300 or more.

11. The composition of claim 1, wherein the polyalkyl (meth)acrylate polymer (B) has a mass-average molecular weight (Mw) in a range of from 1,000 to 1,000,000.

12. The composition of claim 1, wherein the polyalkyl (meth)acrylate polymer (B) has a mass-average molecular weight (Mw) in a range of from 5,000 to 900,000.

13. The composition of claim 1, wherein the polyalkyl (meth)acrylate polymer (B) has a mass-average molecular weight (Mw) in a range of from 20,000 to 800,000.

14. The composition of claim 1, wherein the polyalkyl (meth)acrylate polymer (B) has a mass-average molecular weight (Mw) in a range of from 100,000 to 700,000.

15. The composition of claim 1, wherein the $I_{10}/I_{14}$ ratio of the polyalkyl(meth)acrylate polymer (B) is in a range of from 0.06 to 2.50.

16. The composition of claim 1, wherein the $I_{10}/I_{14}$ ratio of the polyalkyl(meth)acrylate polymer (B) is in a range of from 0.08 to 2.00.

17. The composition of claim 1, wherein the $I_{10}/I_{14}$ ratio of the polyalkyl(meth)acrylate polymer (B) is in a range of from 0.10 to 1.00.

18. The composition of claim 1, wherein the polyalkyl (meth)acrylate polymer (B) comprises, in polymerized form, a macromonomer (α) having a number-average molecular weight (Mn) in a range of from 300 to 100,000.

19. The composition of claim 1, wherein the polyalkyl (meth)acrylate polymer (B) comprises, in polymerized form, a macromonomer (α) in a range of from 0.1 to 10.0 mol. %, based on a total amount of all structural units in the polyalkyl(meth)acrylate polymer (B) being 100 mol. %.

* * * * *